US010383438B2

(12) United States Patent
Duval et al.

(10) Patent No.: US 10,383,438 B2
(45) Date of Patent: Aug. 20, 2019

(54) DEVICES FOR CONTROLLED DISPENSING

(71) Applicant: Cubex LLC, Phoenix, AZ (US)

(72) Inventors: John A. Duval, Long Beach, CA (US); Clifford D. Bennett, Victorville, CA (US); Dmitry Soyfertis, Mountain View, CA (US)

(73) Assignee: Cubex LLC, Phoenix, AZ (US)

( * ) Notice: Subject to any disclaimer, the term of this patent is extended or adjusted under 35 U.S.C. 154(b) by 72 days.

(21) Appl. No.: 14/659,209

(22) Filed: Mar. 16, 2015

(65) Prior Publication Data

US 2016/0270534 A1 Sep. 22, 2016

(51) Int. Cl.

| | |
|---|---|
| ***A47B 88/20*** | (2006.01) |
| ***A47B 97/00*** | (2006.01) |
| ***A47B 96/00*** | (2006.01) |
| ***A47B 67/02*** | (2006.01) |
| ***A47B 88/994*** | (2017.01) |
| ***A47B 88/90*** | (2017.01) |
| *A61J 7/00* | (2006.01) |
| *A47B 88/975* | (2017.01) |

(52) U.S. Cl.

CPC ..... *A47B 67/02* (2013.01); *A47B 88/90* (2017.01); *A47B 88/994* (2017.01); *A47B 96/00* (2013.01); *A47B 88/975* (2017.01); *A47B 2067/025* (2013.01); *A47B 2220/0091* (2013.01); *A61J 7/0069* (2013.01); *A61J 2205/60* (2013.01)

(58) Field of Classification Search

CPC ..... B65D 83/0445; B65D 2583/0481; G07F 11/18; G07F 11/42; G07F 11/44; G07F 11/60; G07F 17/0092

See application file for complete search history.

(56) References Cited

U.S. PATENT DOCUMENTS

| | | | | |
|---|---|---|---|---|
| 1,847,106 | A * | 3/1932 | Turner | E05B 65/462 312/194 |
| 3,150,902 | A | 9/1964 | Naab et al. | |
| 3,259,444 | A | 7/1966 | Friend | |
| 3,318,646 | A | 5/1967 | Ibel | |
| 3,371,974 | A | 3/1968 | Vermeersch | |
| 4,615,572 | A | 10/1986 | Nelson et al. | |
| 4,785,969 | A | 11/1988 | McLaughlin | |
| 5,014,875 | A | 5/1991 | McLaughlin et al. | |
| 5,445,294 | A | 8/1995 | Gardner et al. | |

(Continued)

FOREIGN PATENT DOCUMENTS

| | | |
|---|---|---|
| WO | WO 2017/015066 | 1/2017 |

*Primary Examiner* — Gene O Crawford
*Assistant Examiner* — Kelvin L Randall, Jr.
(74) *Attorney, Agent, or Firm* — Levine Bagade Han LLP

(57) ABSTRACT

Devices and methods for controlled dispensation are described herein where such an assembly may generally comprise an index plate having one or more protrusions extending from a surface of the plate, a first actuator configured to translate the plate in a first direction, and a second actuator configured to translate the plate in a second direction different from the first direction. The one or more protrusions may define one or more rows which are arranged upon the plate in a collinear arrangement and may further define one or more columns which are arranged upon the plate at an angle relative to a proximal or distal edge of the plate such that each protrusion is off-set relative to an adjacent protrusion along the column.

25 Claims, 29 Drawing Sheets

(56) References Cited

U.S. PATENT DOCUMENTS 5,745,366 A 4/1998 Higham et al.
5,805,455 A 9/1998 Lipps
5,805,456 A 9/1998 Higham et al.
5,862,689 A 1/1999 Wen
5,905,653 A 5/1999 Higham et al.
5,927,540 A 7/1999 Godlewski
5,940,306 A 8/1999 Gardner et al.
5,992,709 A 11/1999 Gray
6,011,999 A 1/2000 Holmes
6,039,467 A 3/2000 Holmes
6,109,774 A 8/2000 Holmes et al.
6,116,461 A 9/2000 Broadfield et al.
6,338,007 B1 1/2002 Broadfield et al.
6,339,732 B1 1/2002 Phoon et al.
6,347,848 B1 2/2002 Cho
6,418,416 B1 7/2002 Rosenberg et al.
6,511,138 B1 1/2003 Gardner et al.
6,572,203 B1 * 6/2003 Cheng ..... E05B 65/462 292/DIG. 18
6,609,047 B1 8/2003 Lipps
6,640,159 B2 10/2003 Holmes et al.
6,648,153 B2 11/2003 Holmes
6,760,643 B2 7/2004 Lipps
7,142,944 B2 11/2006 Holmes et al.
7,178,688 B2 * 2/2007 Naufel ..... G07F 17/0092 221/13
7,228,200 B2 6/2007 Baker et al.
7,249,688 B2 7/2007 Hunter et al.
7,588,167 B2 9/2009 Hunter et al.
7,630,789 B2 12/2009 Broadfield et al.
7,630,791 B2 12/2009 Nguyen et al.
7,657,344 B2 2/2010 Holmes et al.
7,668,620 B2 2/2010 Shoenfeld
7,693,603 B2 4/2010 Higham
7,946,663 B2 5/2011 Holcomb
7,992,746 B2 8/2011 Weber
8,061,790 B2 11/2011 Anikhindi et al.
8,065,035 B2 11/2011 Ross et al.
8,090,473 B2 * 1/2012 Higham ..... G07C 9/00912 221/151
8,121,725 B2 2/2012 Baker et al.
8,180,484 B2 5/2012 Baker et al.
8,197,017 B2 6/2012 Rahilly
8,262,174 B2 9/2012 Rahilly
8,335,588 B2 12/2012 Rahilly et al.
8,428,775 B2 4/2013 Baker et al.
8,467,897 B2 6/2013 Holmes et al.
8,517,215 B2 * 8/2013 Shafir ..... A47F 1/00 221/124
8,554,364 B2 10/2013 Holmes et al.
8,706,294 B2 4/2014 Rahilly et al.
8,744,620 B2 * 6/2014 Shavelsky ..... A61J 7/04 700/237
8,749,379 B2 6/2014 Muecke et al.
8,983,653 B2 3/2015 Barrett et al.
9,260,889 B2 2/2016 Stijns et al.
9,295,331 B2 * 3/2016 Slogoff ..... E05B 47/0012
9,355,222 B2 * 5/2016 Chudy ..... G06F 19/3462
10,280,650 B2 * 5/2019 Duval ..... E05B 65/462
2004/0108795 A1 6/2004 Meek et al.
2007/0228899 A1 10/2007 McFarland
2011/0101018 A1 * 5/2011 Shafir ..... A47F 1/00 221/1
2012/0200213 A1 * 8/2012 Savage ..... E05B 1/0092 312/326
2013/0030566 A1 * 1/2013 Shavelsky ..... A61J 7/04 700/244
2013/0112703 A1 5/2013 Shoenfeld
2014/0021843 A1 1/2014 Hashemi et al.
2014/0166598 A1 6/2014 Bird et al.
2014/0326746 A1 * 11/2014 Miedema ..... B65G 59/108 221/297
2016/0324314 A1 11/2016 Duval et al.
2017/0016254 A1 * 1/2017 Duval ..... E05B 65/46 292/200

* cited by examiner

POSITION 6

POSITION 8

DEVICES FOR CONTROLLED DISPENSING

FIELD OF THE INVENTION

The present invention relates to devices and methods for providing controlled dispensing of items from a dispensing cabinet. More particularly, the present invention relates to devices and methods for controlled dispensing of selected items from a secured drawer having one or more locked bins.

BACKGROUND OF THE INVENTION

In many facilities such as hospitals and clinics, selected pharmaceutical and supply items (Items) are held in secure storage locations which are often removed from the patients who use them. As new medications and procedures are prescribed by the doctor, or when prescribed medications or procedures become due, the nurse or technician (the User) uses the secure cabinet to obtain these medications or supplies. The processor on each cabinet is programmable to monitor the access to the pharmaceutical and supply items in these fixed cabinets, allowing the current on hand inventory and the need for replenishment to be communicated to a central processor at the central pharmacy and supply storage locations.

When a user logs into the cabinet's processor, they are typically given access to multiple items, stored behind locked doors or drawers, that selectively unlock. Amongst the many items that can be stored in a cabinet, for certain items, it is desirable to limit access to just a single item type, so the processor can record exactly which items were available to the user to be taken. This is particularly true of narcotic medications. In some cases, it is desirable to limit access to on individual item at a time. These more secure process are achieved by storing items in bins within locked drawers and allow access to individual bins to users, such as nurses. The user will typically enter their own personal identification (ID) and the ID of a specific patient to see medications which are approved overall for that selected patient. Specified bins may then be unlocked to provide access to items such as approved medications which are stored in the unlocked bins. However, while allowing access to certain items, these cabinets may still prohibit to other bins to which the user may be restricted from accessing, particularly in the case of narcotics.

However, in order to limit access to specified bins, the lids on each individual bin must be able to lock and unlock when specified and must also be able to do so repeatedly without failure. This selective locking of the lids typically requires the use of various software systems to track user access and further requires mechanical, electrical, or electro-mechanical mechanisms such as solenoids integrated with each individual bin.

Because of the repeated locking and unlocking of individual bins, the tracking of user access, many of these locking mechanisms are subject to failure resulting in lids which may not lock or unlock properly when needed or resulting in the incorrect lids locking or unlocking improperly. Alternatively, the resulting system may be overly complex and difficult to repair or maintain.

Thus, a system which allows for the tracking as well as locking and unlocking of selected lids from a dispensing cabinet in an efficient, reliable, and repeatable manner is desired.

SUMMARY OF THE INVENTION

The mechanisms described for the controlled dispensing of medication, pharmaceutical agents, or other supplies may be incorporated in any number of dispensing cabinets that are generally utilized in facilities where the automated tracking and dispensation of items is tightly controlled or regulated. These cabinets may incorporate one or more drawers which may have at least one or a plurality of individual bins which are each locked by a lid. Such a drawer assembly may generally comprise a bottom housing which encloses the bottom of the drawer and a top housing which forms a frame for holding and positioning a plurality of bins aligned in a matrix array.

Generally, one variation of an apparatus for selective actuation may comprise an index plate having one or more protrusions extending from a surface of the plate, a first actuator configured to translate the plate in a first direction, a second actuator configured to translate the plate in a second direction different from the first direction, wherein the one or more protrusions define one or more rows which are arranged upon the plate in a collinear arrangement, and wherein the one or more protrusions further define one or more columns which are arranged upon the plate at an angle relative to a proximal or distal edge of the plate such that each protrusion is off-set relative to an adjacent protrusion along the column.

In another variation, an apparatus for selective actuation may generally comprise one or more bins arranged relative to one another and each having a corresponding trigger release arm, an index plate positioned in proximity to the one or more bins and having one or more protrusions extending from a surface of the plate, a first actuator configured to translate the plate in a first direction, a second actuator configured to translate the plate in a second direction transverse relative to the first direction, wherein the one or more protrusions define one or more rows which are arranged upon the plate in a collinear arrangement such that selective translation of the plate along the first direction aligns a single protrusion to a single trigger release arm, and wherein the one or more protrusions further define one or more columns which are arranged upon the plate at an angle relative to a proximal or distal edge of the plate such that each protrusion is off-set relative to an adjacent protrusion along the column such that selective translation of the plate along the second direction engages the single protrusion with the single trigger release arm.

In use, one method for selective actuation using the assemblies described herein may generally comprise translating an index plate in a first direction in proximity to one or more bins arranged relative to one another and each having a corresponding trigger release arm, wherein the index plate has one or more protrusions extending from a surface of the plate and where the one or more protrusions define one or more rows arranged upon the plate in a collinear arrangement, aligning a single protrusion to a single trigger release arm along the first direction, and translating the index plate in a second direction transverse to the first direction such that the single protrusion engages with the single trigger release arm, wherein the one or more protrusions further define one or more columns which are arranged upon the plate at an angle relative to a proximal or distal edge of the plate such that each protrusion is off-set relative to an adjacent protrusion along the column.

With the bins supported by the top housing, they may be positioned above a selector index plate which may comprises a flat plate having a width and a length which is sized to extend along the length of the bottom housing. The width of the index plate may be designed to be relatively shorter than the width of the bottom housing to allow for the index plate to translate within the enclosure. The index plate may define one or more guide slots defined at least partially along the width to accommodate corresponding guides which may protrude from the bottom housing and through the guide slots. The index plate may have a first gear rack and a second gear rack either defined upon the index plate or otherwise attached upon the index plate near or at a respective proximal edge and near or at a respective distal edge of the index plate such that the first rack and second rack extend at least partially along the width of the index plate.

An actuator (e.g., selector motor and encoder) may be secured within the drawer, e.g., near or at the proximal end of the index plate, and the actuator may be in communication with a controller contained either locally within the cabinet or remotely from the cabinet. A selector gear may be rotatably coupled to the actuator and the selector gear may in turn be engaged to a first gear (e.g., pinion gear) positioned adjacent to the selector gear. The first gear may be engaged with the first gear rack and may also be coupled to a drive shaft which extends over the width of the bottom enclosure and index plate where a second gear (e.g., pinion gear) may be attached to a distal end of the drive shaft. The second gear may in turn be rotatably engaged with the second gear rack located along the width of the index plate near or at its distal edge.

The drive shaft and first and second gears may be supported by a first drive shaft support and a second drive shaft support extending from the bottom enclosure such that rotation of the actuator may rotate the selector gear, which in turn may engage the first gear. The first gear may in turn torque the drive shaft about its longitudinal axis to rotate the second gear in a corresponding manner while maintained in place by the first and second drive shaft supports. The corresponding rotation of the first gear and second gear may engage the respective first gear rack and second gear rack along the index plate to urge the translation of the index plate accordingly along its width in a first direction (e.g., translational direction). Because both the first gear rack and second gear rack are engaged simultaneously, translation of the index plate along first direction may be maintained in a smooth and even manner.

In addition to translating the index plate along the first direction, the index plate may also be translated along a second direction, e.g., a direction transverse to the first direction and which is parallel with the direction by which the drawer is opened) when triggering a lid open on a selected bin. A motor such as a release actuator may be mounted within the drawer positioned optionally in proximity to the actuator or mounted in another location within the drawer. Actuating the release actuator may rotate a cam extending from the release actuator such that the release actuator urges the index plate along the second direction. The cam may extend from the release actuator such that it follows within a guide slot defined along the width of the index plate. As the cam is rotated, e.g., a single revolution, it may push against the side of the guide slot at a predetermined distance to urge the index plate a short distance in the second direction.

With the index plate thus configured to translate in a first direction along its with and in a second direction along its length, the index plate may be accordingly positioned within the drawer relative to the bins to open any selected one of the bins. Each of the bins may have a corresponding trigger release arm which protrudes down from a release mechanism along each respective bin and at least partially into the bottom enclosure. The index plate may have a plurality of pins or projections which extend at least partially from the surface of the index plate and these pins or projections may be arranged in a matrix where the individual pins are aligned collinearly with one another along the first direction but staggered or off-set from one another along the second direction such that the column of pins defines an angle along the second direction.

During use, the index plate may be positioned in close proximity to the trigger release arms such that the index plate may freely translate beneath the arms but close enough so that the pins may come into contact at least partially against the arms for actuation. Once a preselected single pin or projection has been aligned with a particular arm which corresponds to a preselected bin to be actuated, the release actuator may be activated to urge the index plate along the second direction such that the aligned pin abuts the selected trigger release arm to release the corresponding lid. Because each of the pins along the column of pins on the index plate are off-set relative to one another, the other pins may slide freely along the second direction without interference so that no other arms are actuated and the other lids remain in their closed state.

The index plate may have a number of rows of pins which correspond to the number of rows of bins in the matrix. However, the number of columns of pins may be less than the number of columns of bins in the matrix array and the index plate may still efficiently release any of the lids of any bin. Although in alternative variations, the number of rows of pins may also be less than the number of rows of bins in the matrix array.

In alternative variations, the drawer may be configured to have any fewer or greater number of bins in which case the index plate may be sized and configured accordingly. In variations where a relatively greater number of bins are configured in the drawer, more than one index plate may be utilized for actuating any of the bins and in any sequence, if so desired, utilizing the position and methods described herein. In other variations, the bins may be arranged in any number of various configurations so long as the drawer is able to accommodate.

In yet another variation, two separate index plates may be used in a drawer with a relatively large number of bins. A first selector index plate having pins arranged in two columns may be positioned adjacent to a second selector index plate similarly having pins arranged in two columns. Each of the index plates may be translated along their width by a single actuator (e.g., selector motor and encoder) which rotatingly engage both index plates along a respective first rack and second rack defined along both of the index plates. In this variation, a single rack along both edges of the index plates may allow for a single actuator to translate both plates along their widths but in alternative variations, each index plate may instead utilize a separate actuator for driving each individual index plate. To translate each of the index plates along their length in the second direction, the first release actuator may be in communication with the first index plate while a second release actuator may be in communication with the second index plate. However, in alternative variations, a single release actuator engaged to both index plates may be used to translate each of the plates simultaneously.

While a single index plate may be utilized for actuating all the bins in the drawer assembly, having two separate index plates positioned adjacent to one another may allow for the translation of one or both plates to efficiently actuate individual bins. Moreover, additional index plates may be utilized, for example, three or more index plates positioned adjacent to one another, if so desired in other variations.

While the drawer assembly may be pulled from the cabinet in which it resides by pulling the entire drawer enclosure, variations of the drawer assembly may optionally incorporate slides which enable a portion of the drawer to be pulled out from the cabinet to access the bins. This assembly may still allow for the lids on individual bins to be actuated, as described herein, and may allow for the entire drawer assembly to be efficiently removed from the cabinet, if needed or desired. It is intended that this variation may be utilized with any of the index plate actuation assemblies described herein and in any combination as so desired.

In addition to the index plate having individual pins projecting from the surface of the plate, alternative variations of the index plate may be used. For instance, the selector index plate may be configured with one or more ridges defined to form a continuous ridge along the length of the index plate such that the ridges protrude from the surface of the index plate rather than having individual pins. Like the pins described herein, the ridges may be formed at an angle relative to the proximal and distal edges of the index plate so that the ridges form an off-set protrusion relative to the plurality of trigger release arms.

The index plate may have a first selector ridge second selector ridge, third selector ridge, and fourth selector ridge forming parallel ridges which protrude from a first surface of the index plate and which are each angled relative to the index plate. In between each of the ridges are one or more index plate ridges which form ridges or protrusions which protrude from the index plate from a second surface of the index plate opposite to the direction of protrusion of the ridges. A release plate may be positioned beneath the index plate in close proximity to the bottom or second surface of the index plate but at a distance to allow for the free and uninhibited translation of the index plate relative to the release plate. The release plate may have one or more ridges which are defined to extend along the width of the release plate such that the ridges protrude from a first or top surface of the plate.

An example is shown where three ridges are defined along the release plate including a first lifter ramp, a second lifter ramp, and a third lifter ramp where each of the lifter ramps are defined to extend along the width of the release plate and are parallel to one another. However, in other variations, the lifter ramps may be formed in other configurations which are not parallel to one another and which may vary in number. Moreover, the lifter ramps may be formed in interrupted (uniformly or otherwise) patterns rather than in a continuous ridge. While the index plate is formed to have a width which is less than a width of the drawer enclosure to allow its translation within the drawer, the release plate may be configured to extend at least to the width of the bin matrix beneath the trigger release arms.

The index plate may be translated along the first direction to reposition the index plate such that a portion of the second ridge is directly beneath the trigger release arm. A first release actuator may be positioned to be in engagement with the index plate for translating the index plate along a first direction along a width of the index plate in a manner similarly described herein while uninhibited by the trigger release arms and the release plate. In this example, the second selector ridge is translated by actuator until a portion of ridge aligned directly beneath a preselected trigger release arm which is engaged with the lid. A second release actuator engaged with the release plate may be configured to translate the release plate along its length such that the one or more lifter ramps may abut against the one or more index plate ridges. This contact by the release plate may cause the index plate to lift away from the release plate. Because the portion of ridge is aligned directly beneath the trigger release arm, the ridge may come into contact and lift the arm to cause the lid to unlock enabling the lid to be opened. Because of the angle at which each of the ridges are aligned and because of their spacing from one another and relative to the spacing between the trigger release arms, the remaining trigger release arms may be un-actuated such that the non-selected lids remain in their locked configuration.

Regardless of the variation of the index plate used, one or more sensors may be incorporated with each of the bins (or at least one bin) to indicate to the controller that a lid has been opened either intentionally from a pre-selected bin or unintentionally. These sensors may function independently of the index plate operation or they may function in conjunction with the index plate positioning. In the event that a lid from a pre-selected bin is opened, the sensor detecting the opened lid may serve as confirmation to the controller that the appropriate lid has been opened. In the event that one or more lids from non-selected bins are opened (unintentionally or unauthorized), the sensors may serve as an indicator of non-authorized access to the non-selected bins.

In either case, one or more sensor grids, e.g., capacitive sensor grids integrated on PCBs, may be incorporated into the drawer assembly. The sensor grids may be one or more sensors, e.g., optical detector, positioned along the grid at locations which correspond to each bin (or at least one bin) release mechanism. Each row or column of the bin matrix may have a corresponding sensor grid extending along the corresponding row or column and at least one interconnecting bus or connector, e.g., drawer open detector and interconnect PCB, may extend along the length or width of the bin matrix for connection to each of the sensor grids. Each of the sensor grids may be electrically coupled to the interconnecting bus or connector which in turn may be electrically coupled or in electrical communication with the controller.

In addition to the various index plates, variably sized bins may be optionally sized in any number of different configurations and regardless of the bin size or configuration, it is intended that any of the index plate variations (including one or more index plate configurations) may be utilized in any combination with these variably sized bin configurations. The bins may be individually formed into separate assemblies which are arranged in the bin matrix array or they may be formed as continuous chambers which extend along the width of the drawer tray and which may be divided into individual bins by the positioning of dividers within selected divider slots. Depending upon the formed bin configuration, a lid of appropriate size may be secured to cover the divided bin. Examples of various lid sizes for accommodating different size bins are shown where the lids may have a first size for a standard bin size, the lids may have a second size which are double the size of the standard bin, and lids may have a third size which are triple the size of the standard bin. Each of the lids, regardless of its size, may utilize a single latch to securely cover the bin and regardless of the bin size and any of the index plate variations described herein may be utilized with any bin size configuration. The controller may be programmed accordingly to actuate the appropriate lid. The example shown in the figure is intended to be illustrative of the various bin configurations. Other variations may utilize any number of bin sizes and configurations and are intended to be within the scope of this disclosure.

To accommodate the variably configured bin arrangement, the number and arrangement of sensor grids may also be varied accordingly. Each of the sensor grids may be connected to the interconnecting bus or connector via connectors. If the bin configurations are altered, the number and positioning of the sensor grids may be altered accordingly.

In yet another variation, the drawer assembly may have separately molded bins each having a lid and trigger release arm which are individually securable in the assembly, e.g., such as by snapping the bin assembly in place within the drawer. This variation may allow for alternative bin array arrangements where the drawer assembly may incorporate individual bin assemblies which are arranged in any number of configurations. Additionally, this variation may allow for the removal and/or insertion of individual bin assemblies from the drawer without having to remove the entire drawer.

The drawer may incorporate a closing mechanism such as a plate or shelf having one or more rollers incorporated along its distal edge. If one or more lids were in an open configuration, closing the drawer relative to the closing mechanism may force the lids to close shut automatically.

With the use of the devices and methods described herein, use of the actuators in the manner described may save on parts and assembly costs as the assemblies described may utilize fewer components than conventional systems. Moreover, the number of bins may be scaled to any number for use with the index plate assemblies.

These variations and any of the different features described herein are intended to be utilized in any number of combinations with the different index plate variations. While specific combinations described herein are intended to be illustrative, other various combinations are expressly intended to be within the scope of this disclosure.

DETAILED DESCRIPTION OF THE INVENTION

Figure 1:
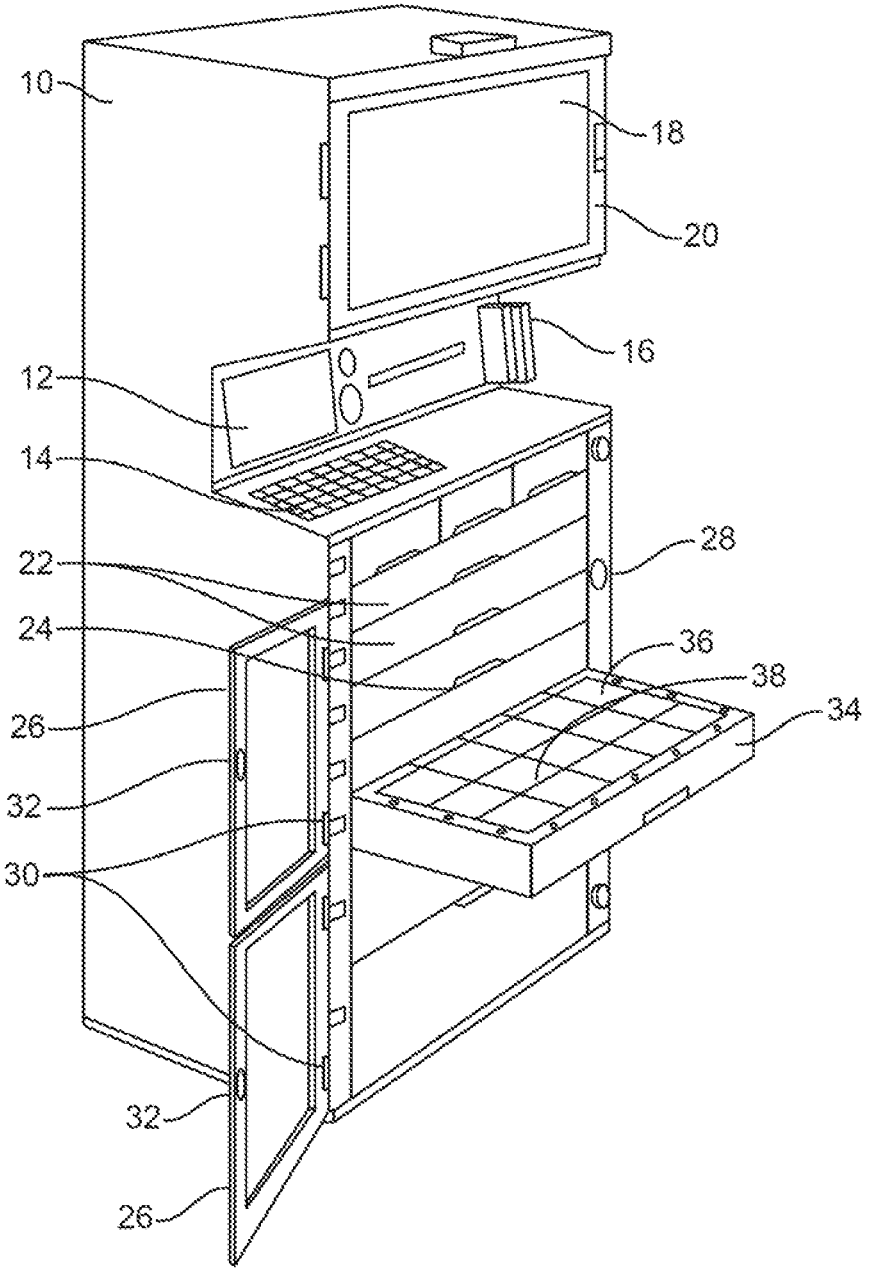
FIG. 1 shows a perspective view of one example of a dispensing cabinet which may incorporate the various devices and methods described.

The mechanisms described for the controlled dispensing of medication, pharmaceutical agents, or other supplies may be incorporated in any number of dispensing cabinets that are generally utilized in facilities where the automated tracking and dispensation of supplies is tightly controlled or regulated. An example of a typical dispensing cabinet is shown in the perspective view of FIG. 1 which is commonly utilized in many acute care facilities. Such cabinets 10 generally incorporate a user interface 12 such as a touch-screen as well as a keyboard 14 or other user input device which is in communication with a processor. Additionally, an automated identification interface 16, e.g., magnetic card reader, bar code reader, fingerprint reader (or other biometric identification device), etc., may also be incorporated and in communication with the processor.

While the configuration of the cabinet 10 may be widely varied, this example illustrates how the cabinet 10 may include a compartment 18 which is covered by a locking door 20. Another configuration is shown where the cabinet 10 may include one or more individual drawers 22 each which when unlocked may spring forward, or alternatively have an optional handle 24 for opening and accessing each of the drawers 22, once unlocked. While the drawers 22 may be individually locked or unlocked, access to the drawers 22 themselves may be further controlled by one or more optional locking doors 26 that can selectively cover one or more of the drawers 22. The one or more doors 26 may optionally locked via a locking mechanism 28 and opened via hinges 30 and individual handles 32 to open and close the doors 26 for gaining access to the drawers 22 which may also be selectively locked as well depending upon the level of access provided to a user.

Each of the drawers 22 may include one or more individual bins 36 which may be individually opened or which may have a non-locking or locking lid 38, as shown in the opened drawer 34. The drawers 22, doors 26, as well as the individual lids 38 may incorporate one or more sensors, as known in the art, which may communicate with the processor to sense, detect, and/or track which drawers, doors, or lids are being accessed by the user. In many cases, the user needs access to all the drawers 22, or, if a user is restricted, it is usually to a broad class such as narcotics, that can be kept in one group of drawers. However, controlled access to individual bins 36 within a drawer is needed in many instances.

Hence, controlling access to a particular bin 36 is needed not only for restricting access but also for tracking purposes. In such a case, a user will generally enter their identification such as through identification interface 16 or through interface 12, 14 such as by entry of an optional password. Once the user gains electronic entry to the system, one or more particular items in a corresponding drawer 22 and corresponding bin 36 may be unlocked to provide access to the previously locked item. However, if the lids 38 in a drawer 22 are each locked, access may be provided to the user only to one or more individual bins 36 by unlocking only those individual bins 36 while maintaining the remaining lids 38 in a locked state to restrict their access.

Figure 2A:
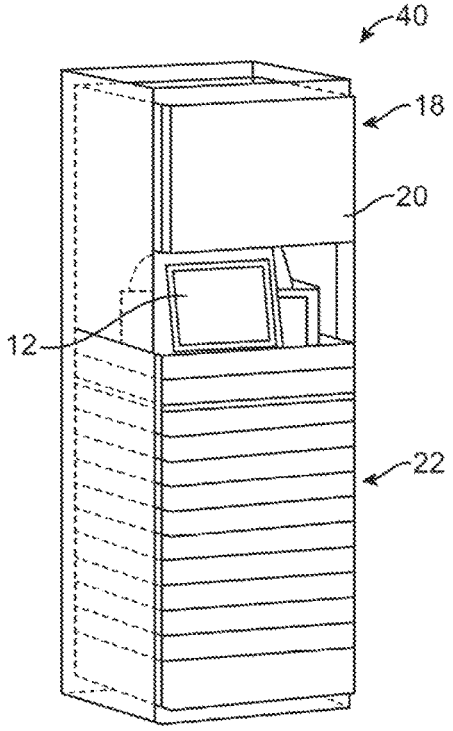
FIGS. 2A to 2D show perspective views of various dispensing cabinets which may incorporate the various devices and methods described.
Figure 2B:
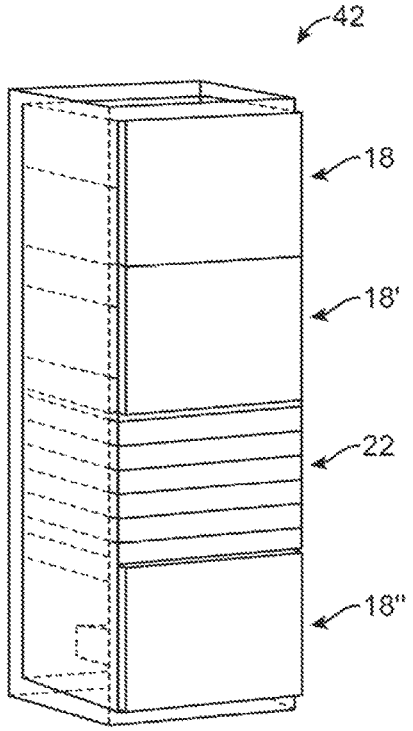

The unlocking of selected individual bins 36 may be accomplished by one or more selector index plate assemblies which may effectively and efficiently seek and unlock a selected bin 36, as described in further herein. The use of a selector plate assembly and variations of the plate assembly may be utilized in any number of storage applications where the release of the stored contents is to be controlled. The cabinets 10 as described above may incorporate such assemblies as well as other cabinet storage variations such as the cabinet 40 shown in the perspective view of FIG. 2A. This cabinet variation 40 may similarly include a user interface 12, one or more compartments 18 having a locking door 20 as well as one or more drawers 22. Other examples of cabinets which may incorporate the selector plate assemblies and its variations are shown in the perspective view of FIG. 2B which illustrates an auxiliary cabinet 42 variation having multiple compartments 18, 18', 18" with corresponding locking doors and also one or more drawers 22.

Figure 2C:
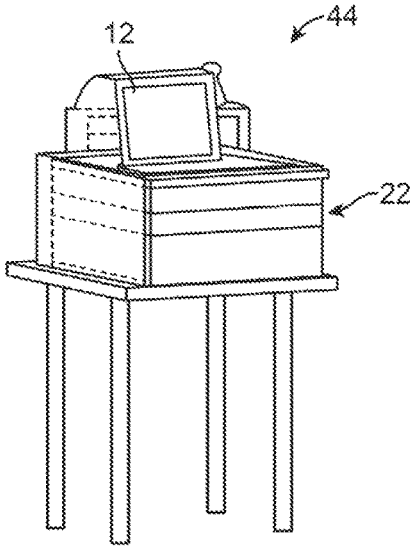
Figure 2D:
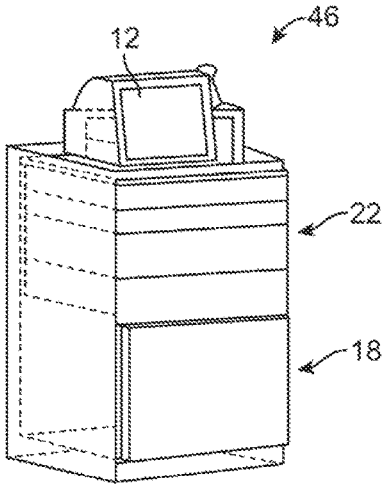

Another variation is shown in the perspective view of FIG. 2C which illustrates a table top station 44 optionally including a user interface 12 and one or more drawers 22 and a half-height station 46 variation shown in the perspective view of FIG. 2D which illustrates a shortened cabinet 46, user interface 12, compartment 18, and one or more drawers 22. These examples of various cabinets are not intended to be exhaustive but merely illustrative of the various cabinet types which may incorporate one or more variations of the selector plate assemblies described herein. Additionally, each of the drawers 22 in a single cabinet may incorporate the same selector plate assembly mechanism between each drawer. Alternatively, different drawers in the same cabinet may incorporate different variations of the selector plate assemblies described herein.

Figure 3:
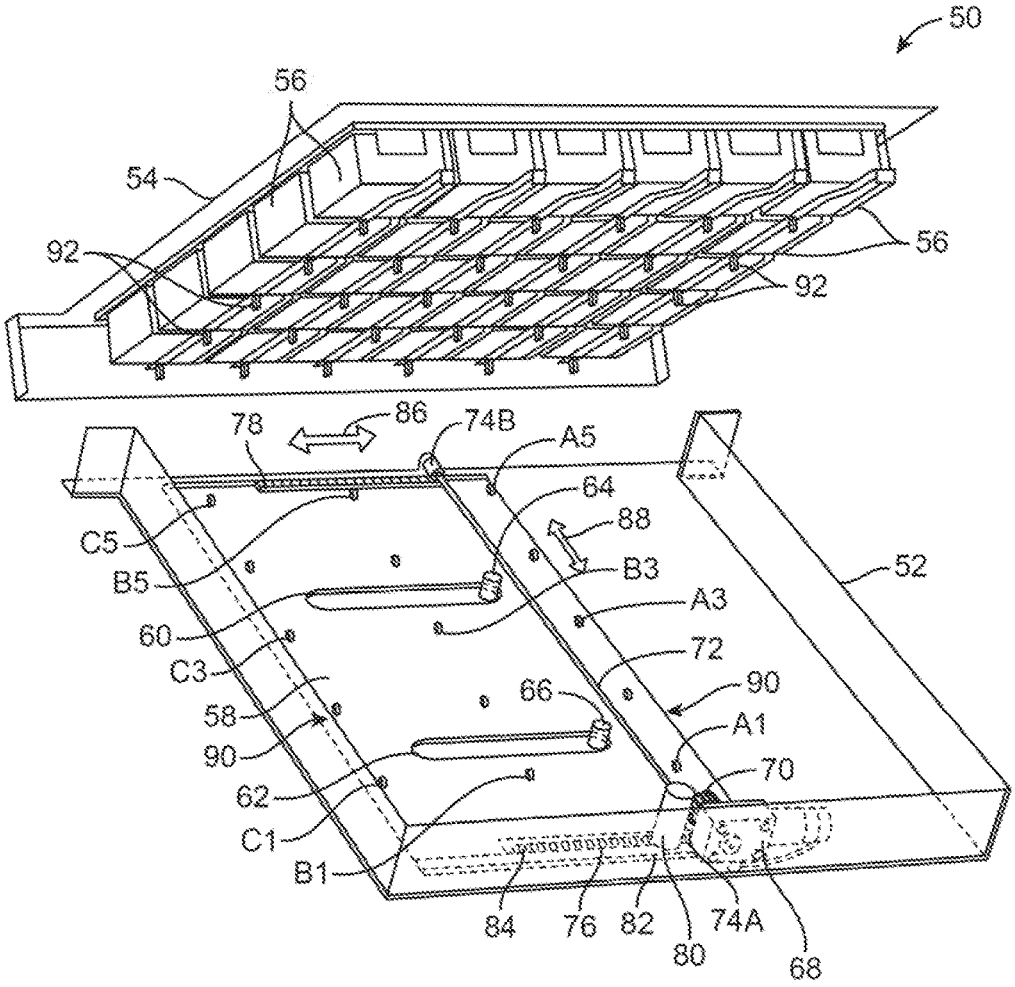
FIG. 3 shows a perspective exploded view of one example of a drawer and a selector index plate.

FIG. 3 shows an exploded view of one example of a locking drawer assembly 50 which incorporates an unlocking mechanism for selectively unlocking individual bins. In this variation, the drawer assembly 50 may generally comprise a bottom housing 52 which encloses the bottom of the drawer and a top housing 54 which forms a frame for holding and positioning a plurality of bins 56 aligned in a matrix array. In this example, there are thirty bins 56 uniformly arranged to be in five rows by six columns although in other variations, the number of bins may be varied and the arrangement and/or alignment of the bins 56 may be positioned in other configurations as well, e.g., parallel, radial, circular, angled, etc.

With the bins 56 supported by the top housing 54, they may be positioned above a selector index plate 58 which may comprises a flat plate having a width and a length (e.g., in this variation, a width of about 22 inches and a length of about 22 inches) which is sized to extend along the length of the bottom housing 52. Such an index plate 58 may be fabricated from any number of materials, e.g., steel, plastic, aluminum, wood, composites, etc. The width of the index plate 58 may be designed to be relatively shorter than the width of the bottom housing 52 to allow for the index plate 58 to translate within the enclosure. The index plate 58 may define one or more guide slots 60, 62 defined at least partially along the width to accommodate corresponding guides 64, 66 which may protrude from the bottom housing 52 and through the guide slots 60, 62. The index plate 58 may have a first gear rack 76 and a second gear rack 78 either defined upon the index plate 58 or otherwise attached upon the index plate 58 near or at a respective proximal edge and near or at a respective distal edge of the index plate 58 such that the first rack 76 and second rack 78 extend at least partially along the width of the index plate 58.

Figure 4A:
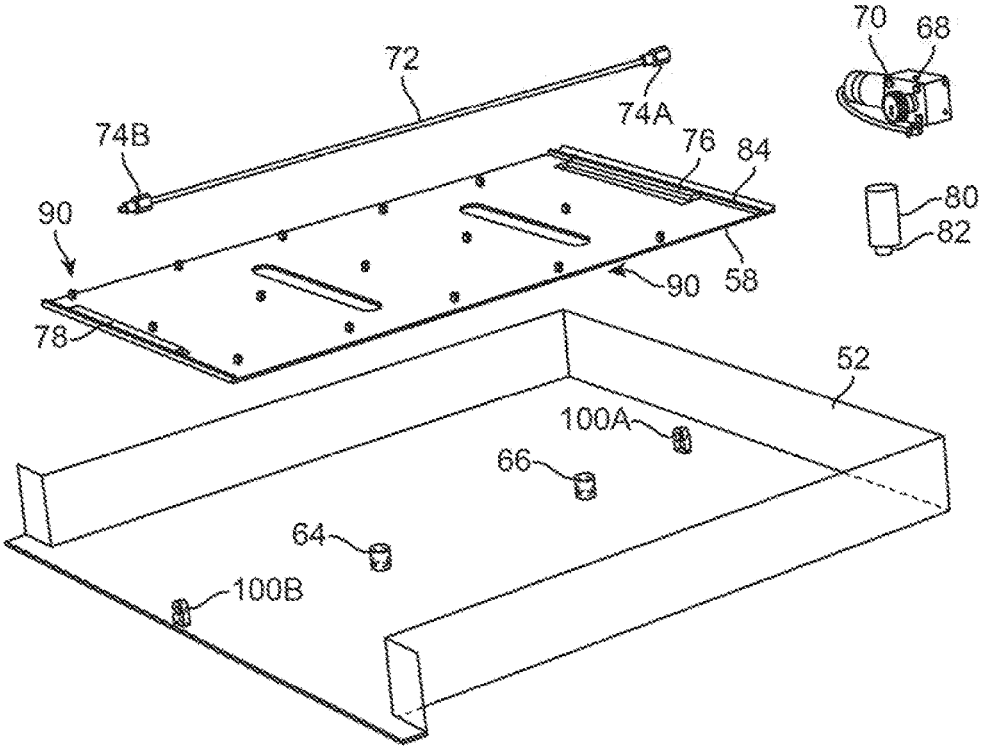
FIG. 4A shows a perspective view of the drawer bottom housing, selector index plate, and selector gear motor.

An actuator 68 (e.g., selector motor and encoder) may be secured within the drawer, e.g., near or at the proximal end of the index plate 58, and the actuator 68 may be in communication with a controller contained either locally within the cabinet or remotely from the cabinet. A selector gear 70 may be rotatably coupled to the actuator 68 and the selector gear 70 may in turn be engaged to a first gear 74A (e.g., pinion gear) positioned adjacent to the selector gear 70. The first gear 74A may be engaged with the first gear rack 76 and may also be coupled to a drive shaft 72 which extends over the width of the bottom enclosure 52 and index plate 58 where a second gear 74B (e.g., pinion gear) may be attached to a distal end of the drive shaft 72. The second gear 74B may in turn be rotatably engaged with the second gear rack 78 located along the width of the index plate 58 near or at its distal edge, as also shown in the exploded perspective view of FIG. 4A.

The drive shaft 72 and first and second gears 74A, 74B may be supported by a first drive shaft support 100A and a second drive shaft support 100B extending from the bottom enclosure 52 such that rotation of the actuator 68 may rotate the selector gear 70, which in turn may engage the first gear 74A. The first gear 74A may in turn torque the drive shaft 72 about its longitudinal axis to rotate the second gear 74B in a corresponding manner while maintained in place by the first and second drive shaft supports 100A, 100B. The corresponding rotation of the first gear 74A and second gear 74B may engage the respective first gear rack 76 and second gear rack 78 along the index plate 58 to urge the translation of the index plate 58 accordingly along it width, as indicated by first direction 86 (e.g., translational direction). Because both first gear rack 76 and second gear rack 78 are engaged simultaneously, translation of the index plate 58 along first direction 86 may be maintained in a smooth and even manner.

Figure 4B:
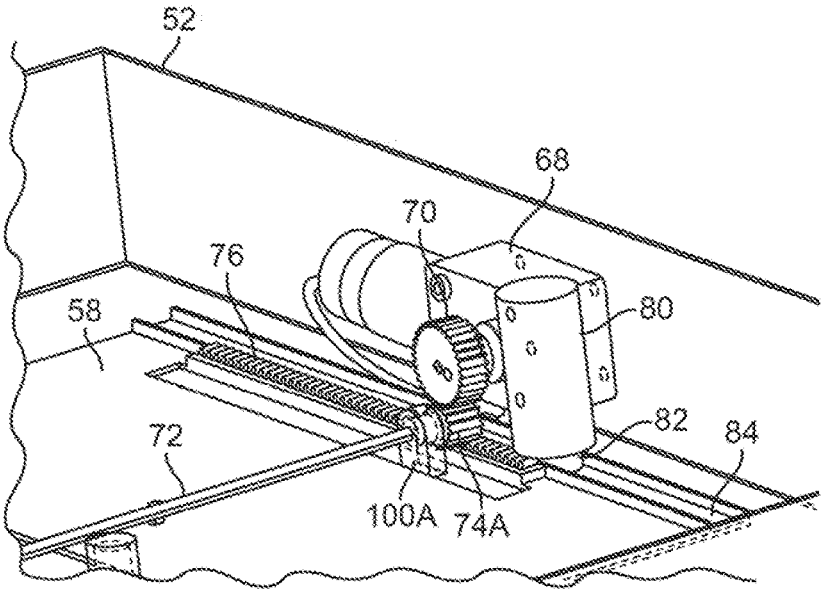
FIG. 4B shows a detail perspective view of the selector gear motor engaged with a drive shaft and selector index plate.

Referring back to FIG. 3, in addition to translating the index plate 58 along the first direction 86, the index plate 58 may also be translated along a second direction 88, e.g., a direction transverse to the first direction 86 and which is parallel with the direction by which the drawer is opened) when triggering a lid open on a selected bin 56. A motor such as a release actuator 80 may be mounted within the drawer positioned optionally in proximity to the actuator 68, as shown, or mounted in another location within the drawer. As further shown in the detail perspective view of FIG. 4B, actuating the release actuator 80 may rotate a cam 82 extending from the release actuator 80 such that the release actuator 80 urges the index plate 58 along the second direction 88. The cam 82 may extend from the release actuator 80 such that it follows within a guide slot 84 defined along the width of the index plate 58. As the cam 82 is rotated, e.g., a single revolution, it may push against the side of the guide slot 84 at a predetermined distance to urge the index plate 58 a short distance in the second direction 88.

With the index plate 58 thus configured to translate in a first direction 86 along its with and in a second direction 88 along its length, the index plate 58 may be accordingly positioned within the drawer relative to the bins 56 to open any selected one of the bins. Each of the bins 56 may have a corresponding trigger release arm 92 which protrudes down from a release mechanism along each respective bin 56 and at least partially into the bottom enclosure 52. The index plate 58 may have a plurality of pins or projections 90 which extend at least partially from the surface of the index plate 58, e.g., 0.10 in to 0.30 in, and these pins or projections 90 may be arranged in a matrix where the individual pins are aligned collinearly with one another along the first direction 86 but staggered or off-set from one another along the second direction 88 such that the column of pins 90 defines an angle, e.g., 2 to 5 degrees, along the second direction 88. In other variations, these pins 90 may be aligned in alternative arrangements which are regular or irregular in pattern. Moreover, the pins may be formed into any number of shapes having various cross-sections, e.g., circular, square, polygonal, curved, etc. The variation shown in FIG. 3 illustrates an example of an index plate 58 which is configured for a matrix of thirty bins 56 having five rows and six columns. For such a configuration, the pins 90 may be off-set from an adjacent pin 90 at, e.g., 0.10 in to 0.30, along the second direction 88.

The index plate 58 may be shown having a first pin A1 along the first column and first row, second pin A2 along the first column and second row, third pin A3 along the first column and third row, fourth pin A4 along the first column and fourth row, and fifth pin A5 along the first column and fifth row. The second column may have a first pin B1 along the second column and first row, second pin B2 along the second column and second row, third pin B3 along the second column and third row, fourth pin B4 along the second column and fourth row, and fifth pin B5 along the second column and fifth row. Likewise, the third column may have a first pin C1 along the third column and first row, second pin C2 along the third column and second row, third pin C3 along the third column and third row, fourth pin C4 along the third column and fourth row, and fifth pin C5 along the third column and fifth row.

With such an arrangement, the pins 90 along the index plate 58 may trigger any of the trigger release arms 92 to release a corresponding lid, as described in further detail herein. Moreover, while the configuration of the index plate 58 shown is for a drawer variation having thirty bins, other drawer variations having different arrangements of the bins as well as differing number of bins may have an index plate 58 which is configured in an alternative arrangement; however, the method of operation may remain essentially similar.

Figure 5A:
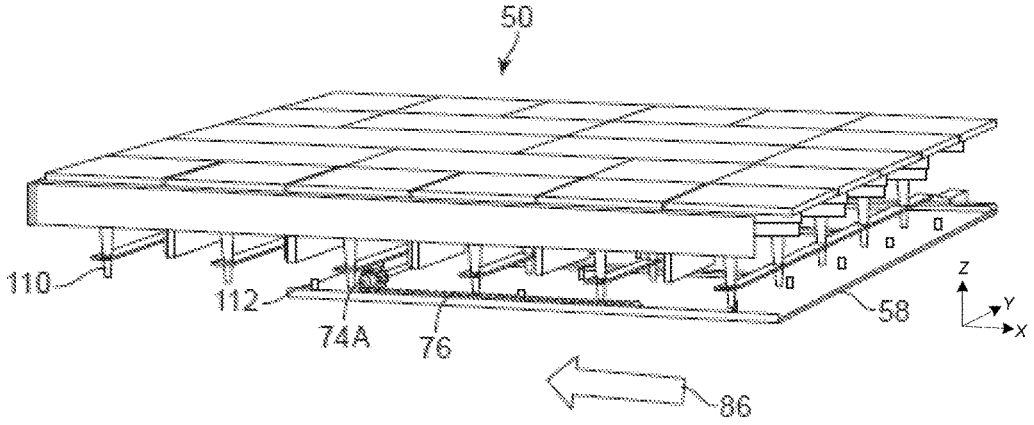
FIGS. 5A and 5B show perspective views of an example of selector index plate movement relative to the bins.
Figure 5B:
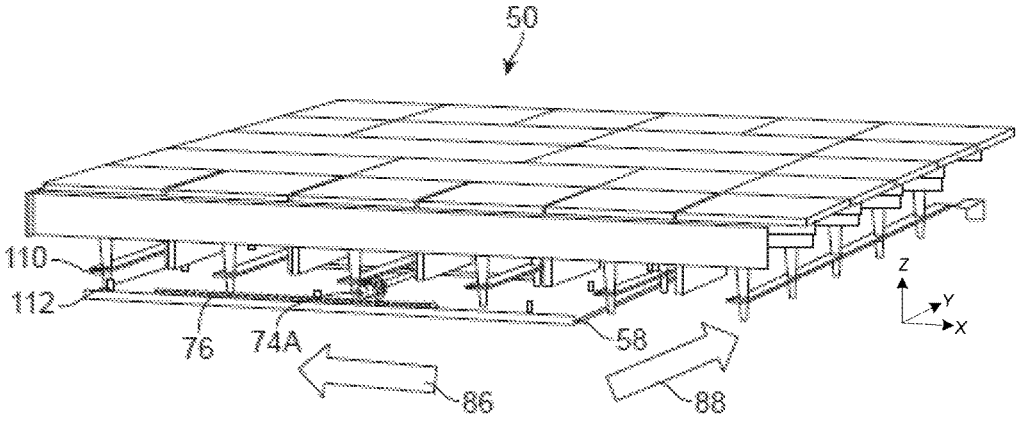

An example for operating the index plate 58 is shown in the perspective views of FIGS. 5A and 5B. In this variation, the drawer assembly 50 may be seen having a plurality of bins 56 arranged in a matrix pattern with respective trigger release arms 110 extending into the enclosure above the index plate 58. The index plate 58 may be positioned in close proximity to the trigger release arms 110 such that the index plate 58 may freely translate beneath the arms 110 but close enough so that the pins 90 may come into contact at least partially against the arms 110 for actuation. This example shows how the index plate 58 may be translated along the first direction 86 while each of the pins 90 are off-set from each of the arms 110 to allow for the free travel of the index plate 58 through the drawer without interference. Once a preselected single pin or projection, such as pin 112, has been aligned with a particular arm 110 which corresponds to a preselected bin to be actuated, as shown in FIG. 5B, the release actuator 80 may be activated to urge the index plate 58 along the second direction 88 such that the aligned pin 112 abuts the selected trigger release arm 110 to release the corresponding lid. Because each of the pins 90 along the column of pins on the index plate 58 are off-set relative to one another, the other pins 90 may slide freely along the second direction 88 without interference so that no other arms 110 are actuated and the other lids remain in their closed state.

Figure 6A:
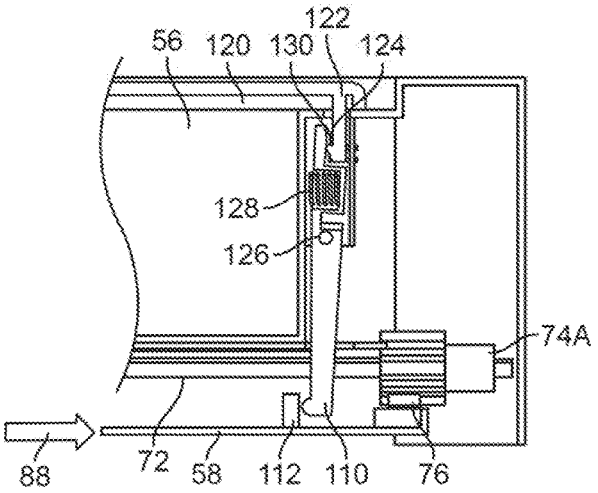
FIGS. 6A to 6C show side views of how the selector index plate may be translated in a transverse direction to release a preselected lid from a locked position to an unlocked position.
Figure 6B:
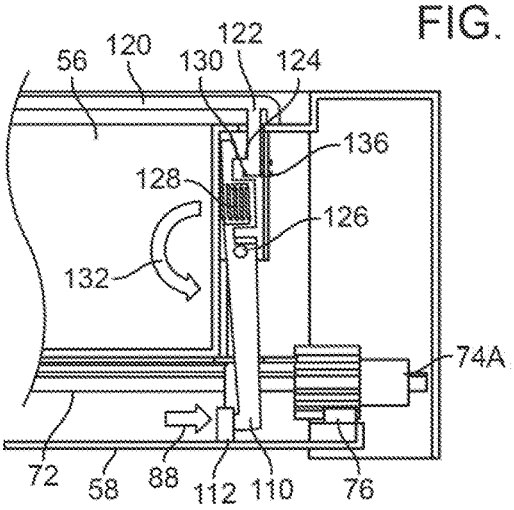
Figure 6C:
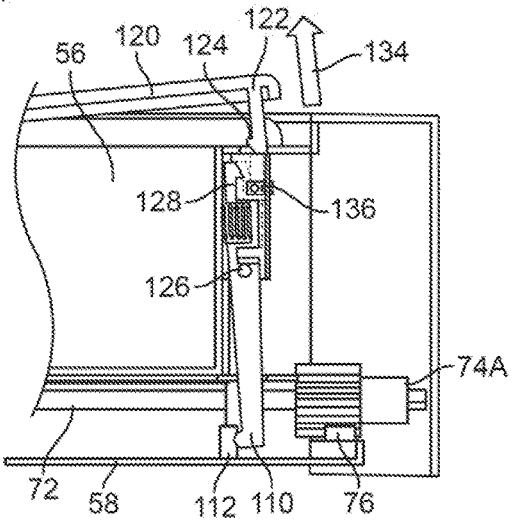

FIGS. 6A to 6C show detail cross-sectional side views illustrating the release of a particular preselected lid. As previously discussed, once the pin 112 has been translated along the first direction 86 to a preselected bin 56, the pin 112 may be aligned with the trigger release arm 110, as shown in FIG. 6A. The lid 120 may be seen in its locked position upon the bin 56. In this variation, the lid 120 may have a locking arm 122 which extends down and defines a latch 124 which may abut a trigger arm latch 130 defined along a portion of the locking arm 122. The trigger arm latch 130 may remain biased in an engaged configuration against the latch 124 while a biasing member 128, e.g., spring, presses against a portion of the arm 122. Once the release actuator 80 is activated, the index plate 58 and pin 112 may translate along the length of the index plate 58 in the second direction 88. The first gear rack 76 and second gear rack 78 may slide relative to the drive shaft 72 and first gear 74A and second gear 74B, as shown in FIG. 6B, as the index plate 58 is translated. This translation along the second direction 88 may urge pin 112 directly against the lower portion of trigger release arm 110 such that arm 122 rotates about a pivot 126 against the biasing member 128 in the direction of motion 132. The rotation of arm 122 accordingly releases trigger arm latch 130 from latch 124 allowing for the lid 120 to release and open unrestricted, as shown by the direction of lid release 134 in FIG. 6C. The lid 120 may move in the open direction, either due to the user physically lifting the lid, or may spring partially open due to the lid 120 being spring loaded. Aside from unlocking the lid 120, the bin 56 may instead be configured to lock the lid 120 from an unlocked state in alternative variations.

While the movement of the index plate 58 along the first direction 86 and second direction 88 are shown as being linear, other variations may move the index plate 58 in alternative motions instead, e.g., linear, curved, rounded, etc. for actuating the trigger release arm. Moreover, while actuation of the trigger release arm is described as a mechanical actuation created by the abutment of the pin against the trigger release arm, other actuation mechanisms may incorporate various other motions or mechanisms such as rollers, levers, springs, hinges, pivots, linear slides etc. and may also include alternative interactions such as electrical transmission, induction, optics, pneumatic, hydraulic, etc. Additionally, the index plate 58 may be configured to actuate any number of trigger release arms sequentially or simultaneously in alternative configurations.

An optional sensor 136, e.g., optical detector, may be positioned in proximity to the lid 120 or locking arm 122 to indicate to the controller that the corresponding lid 120 is in an open configuration. The variation of the lid 120 and its locking arm 122 as well as the trigger release arm 110 is shown as one variation of how the pin 112 may be utilized to release the lid 120. Other release mechanisms may be utilized in alternative variations and are intended to be within the scope of this disclosure.

Figure 7A:
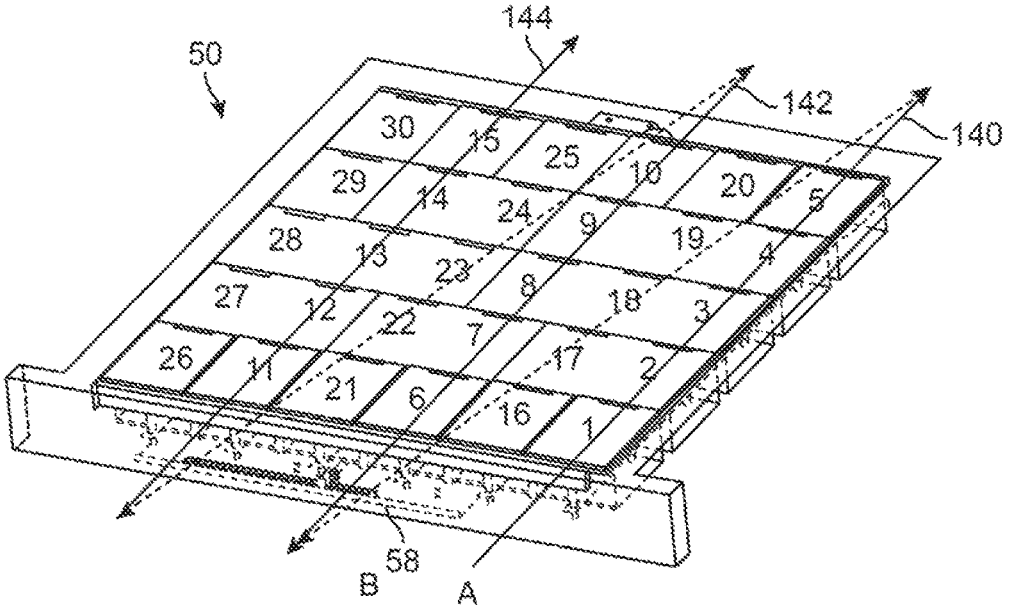
FIGS. 7A and 7B show perspective views of an opening sequence for each of the bins when the selector index plate movement is minimized across all bins.

The index plate 58 may have a number of rows of pins which correspond to the number of rows of bins in the matrix. However, the number of columns of pins may be less than the number of columns of bins in the matrix array and the index plate 58 may still efficiently release any of the lids of any bin. Although in alternative variations, the number of rows of pins may also be less than the number of rows of bins in the matrix array. In the variation shown in the perspective view of FIG. 7A, a bin opening sequence for a drawer having thirty bins is shown to illustrate how an index plate 58 having its pins arranged in a staggered or offset configuration may be used to open each of the bins. If the index plate 58 were aligned with the bins along the first column such that the pin in the first row and first column were aligned to open the bin labeled 1, the subsequent bins along the first column would naturally align in a sequence for opening if the index plate 58 were further translated. Once the last bin in the first column is opened, the subsequent alternating column would then become aligned with the column of pins along the index plate 58.

Figure 7B:
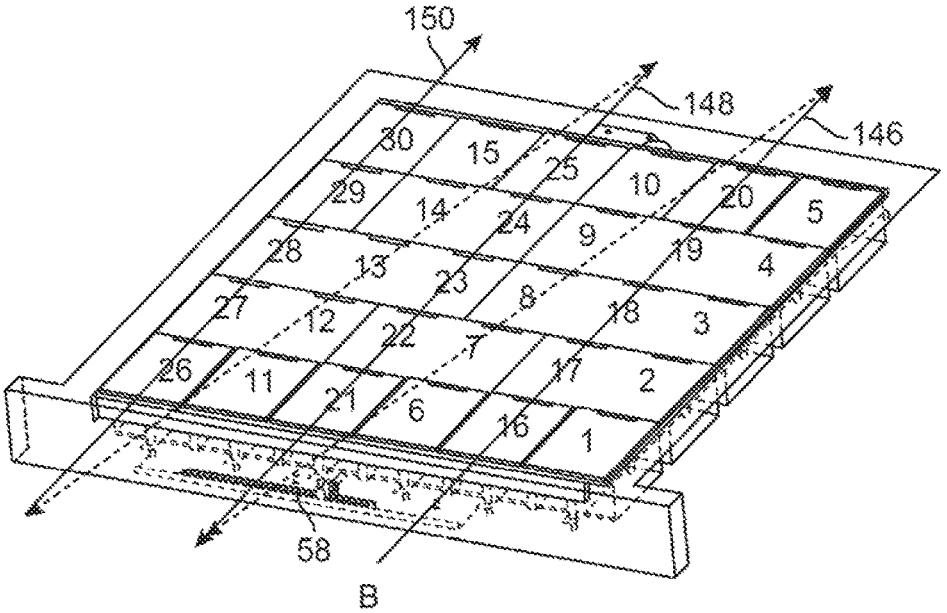

For instance, a bin opening sequence along first column 140 for bins labeled sequentially 1 to 5 may be seen. The following bin opening sequence along third column 142 for bins labeled 6 to 10 may be opened next. Then the bin opening sequence along fifth column 144 for bins labeled 11 to 15 may be opened next. AS the index plate 58 is further translated along its width, the pins of its first column may then align for the opening sequence along second column 146 for bins labeled 16 to 20. Further translation of the index plate 58 may then align its second column with the bin opening sequence along fourth column 148 for bins labeled 21 to 25, and the pins of the third column of pins of the index plate 58 may then align for the bin opening sequence along sixth column 150 for bins labeled 26 to 30, as shown in FIG. 7B.

Figure 8A:
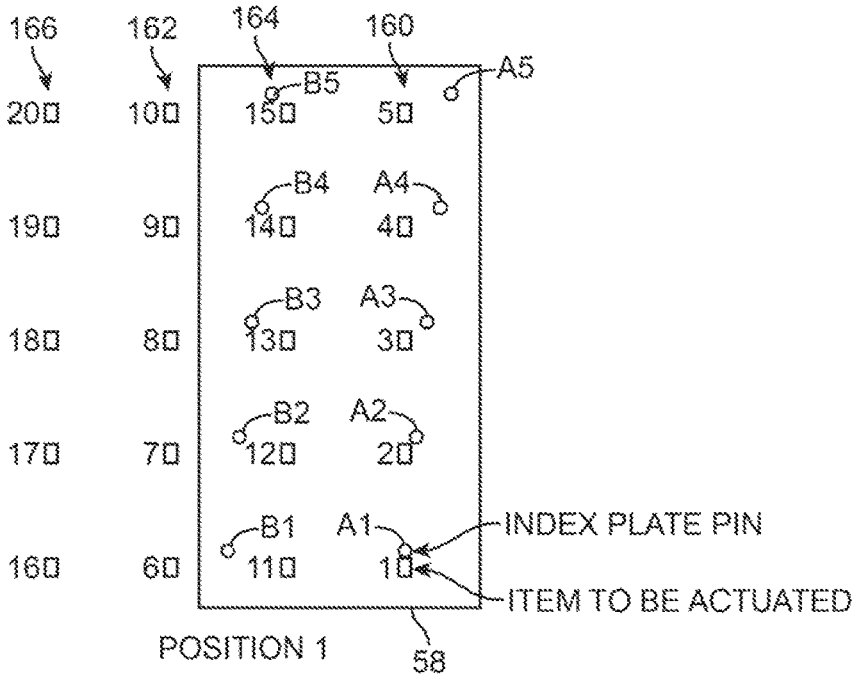
FIGS. 8A to 8K show schematic views illustrating how the selector index plate may be optimally translated and positioned for selectively opening a bin.

Another example of the staggered pin alignment along index plate 58 is shown in the schematic views of FIGS. 8A to 8K. In these examples, a bin opening sequence for a drawer having twenty bins is shown for illustrative purposes. FIG. 8A shows a schematic illustration of an index plate 58 having two columns of pins where first pin A1 is positioned at the first column and first row, second pin A2 is positioned at the first column and second row, third pin A3 is positioned at the first column and third row, fourth pin A4 is positioned at the first column and fourth row, and fifth pin A5 is positioned at the first column and fifth row. Likewise, first pin B1 is positioned at the second column and first row, second pin B2 is positioned at the second column and second row, third pin B3 is positioned at the second column and third row, fourth pin B4 is positioned at the second column and fourth row, and fifth pin B5 is positioned at the second column and fifth row.

The matrix array of bins is shown for illustrative purposes as having a first column 160 for bins labeled 1 to 5, second column 162 for bins labeled 6 to 10, third column 164 for bins labeled 11 to 15, and fourth column 166 for bins labeled 16 to 20.

As the index plate 58 is aligned in position to actuate bin 1, pin A1 may be translated along its width and aligned to be adjacent to bin 1, as shown in FIG. 8A. Because each of the pins on index plate 58 is slightly off-set relative to the trigger release arm of the bins, translation of the index plate 58 along the first direction may occur uninhibited. Once the pin A1 has been aligned, the release actuator 80 may be activated to translate the index plate 58 in the second direction along the length to actuate the trigger release arm for bin 1. As further shown, because each of the pins A1 to A5 on the index plate 58 in the first column are off-set, movement of the index plate 58 in the second direction may be accomplished to actuate only the selected bin without the pins A2 to A5 actuating any of the remaining trigger release arms 2 to 5 along first column 160. The remaining pins B1 to B5 on the index plate 58 along its second column are also shown to be off-set relative to the trigger release arms 11 to 15 along second column 164.

Figure 8B:
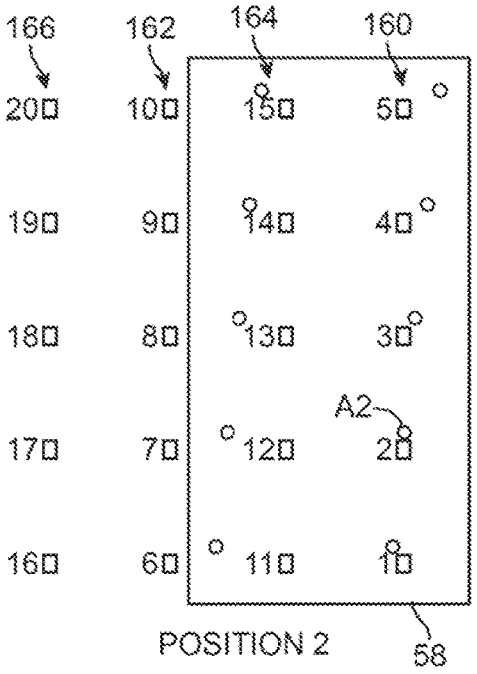
Figure 8C:
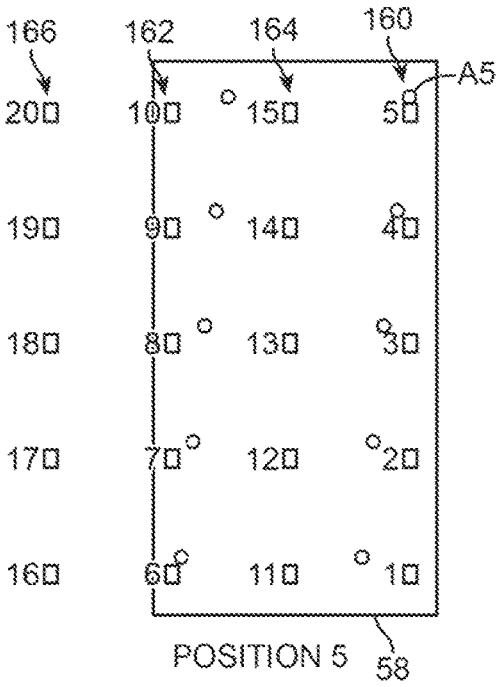
Figure 8D:
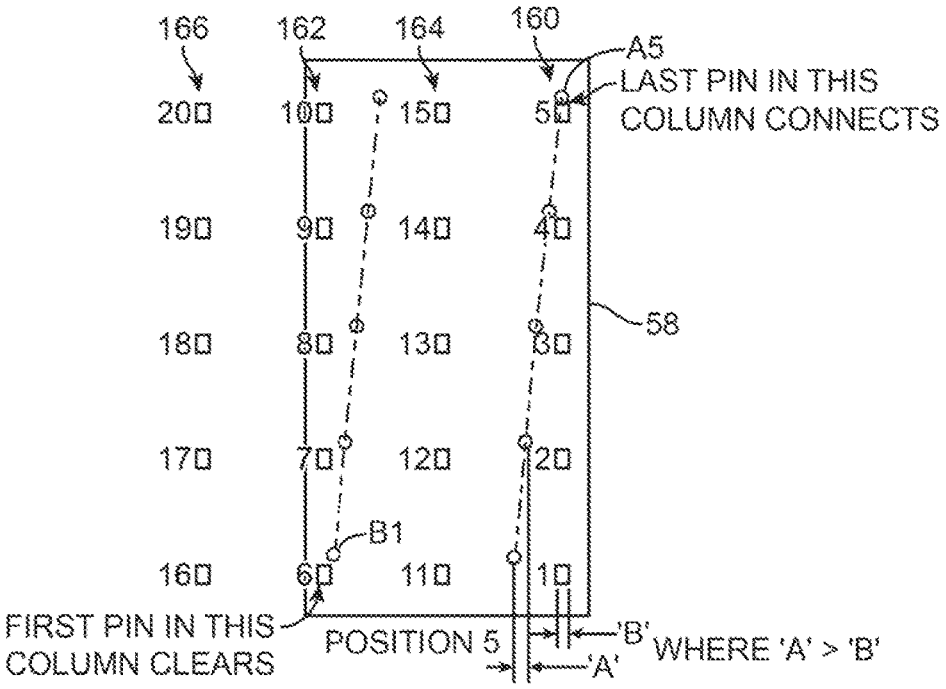
Figure 8E:
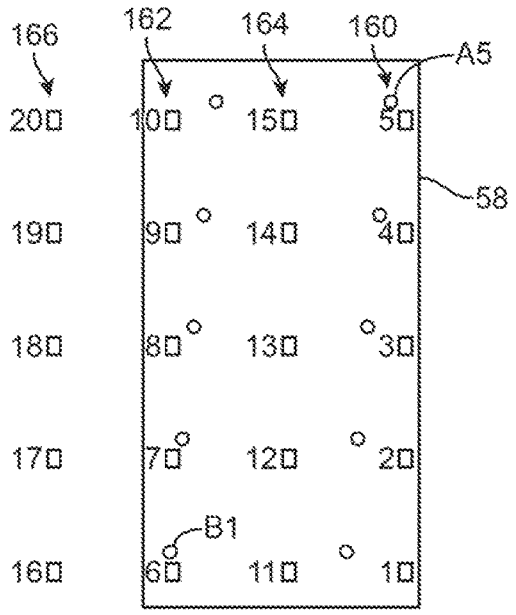

As shown in FIG. 8B, in order to actuate the trigger release arm of bin 2, index plate 58 may be translated slightly along the first direction until the second pin A2 is aligned accordingly. The release actuator 80 may then be activated accordingly. As also shown, the remaining pins A1 and A3 to A5 along the first column of index plate 58 and the remaining pins B1 to B5 remain clear of the trigger release arms when the release actuator 80 is activated. In the event that the trigger release arm for bin 4 or bin 5 are actuated, the process may be repeated, as shown in FIG. 8C which shows alignment of the pin A5 with the trigger release arm for bin 5. As shown in FIG. 8D, when the pin A5 is aligned with trigger release arm for bin 5, each of the remaining pins remain clear of the remaining trigger release arms. Hence, the translational distance between each adjacent pin, such as the distance A between pins A1 and A2, may be greater than the width B of the trigger release arms, as illustrated.

Figure 8F:
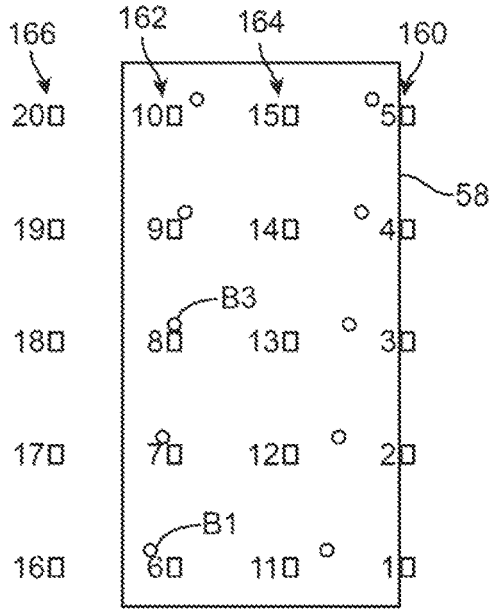
Figure 8G:
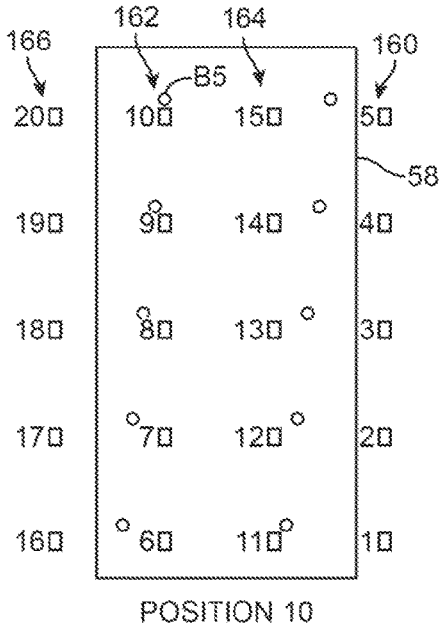
Figure 8H:
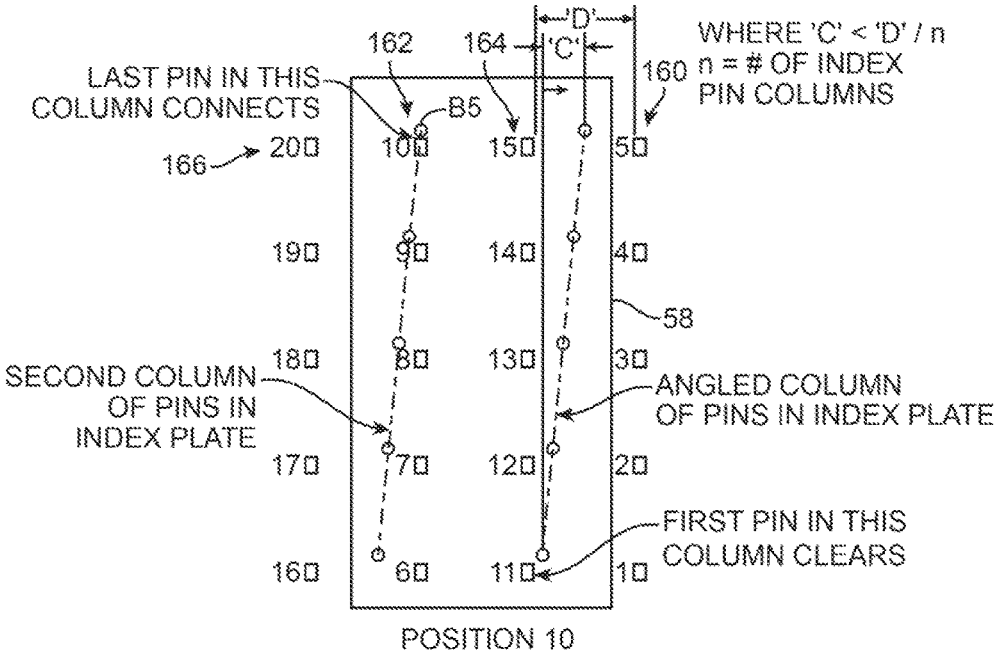

Further translation of the index plate 58 along the first direction may align the pin B1 of the second column with the trigger release arm for bin 6 which is located along the second column 162. Likewise, as the index plate 58 is further translated, the respective pins such as pin B3 may be aligned with trigger release arm for bin 8, as shown in FIG. 8F, and so on until the remaining pin B5 is aligned with trigger release arm for bin 10, as shown in FIG. 8G. As illustrated in FIG. 8H, having the translational distance C between the first pin A1 and last pin A5 of a column on the index plate 58 be less than the distance D between the adjacent trigger arms may ensure that translational movement of index plate 58 along the second direction may occur without triggering any non-selected trigger release arms.

Figure 8I:
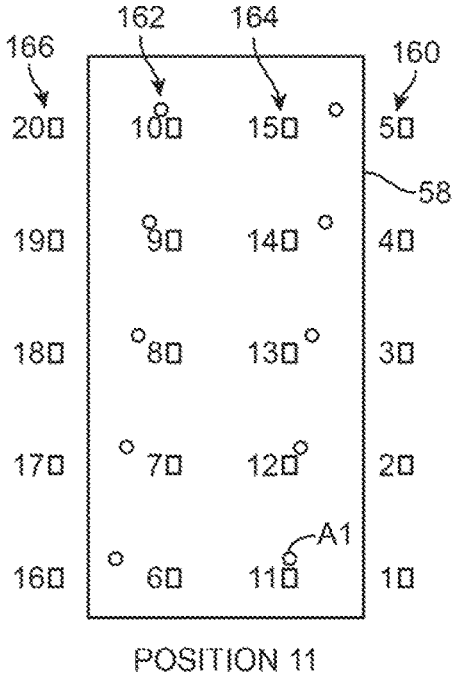
Figure 8J:
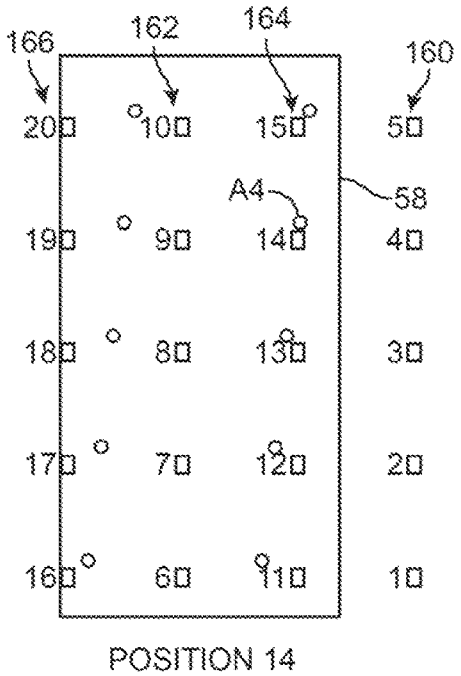
Figure 8K:
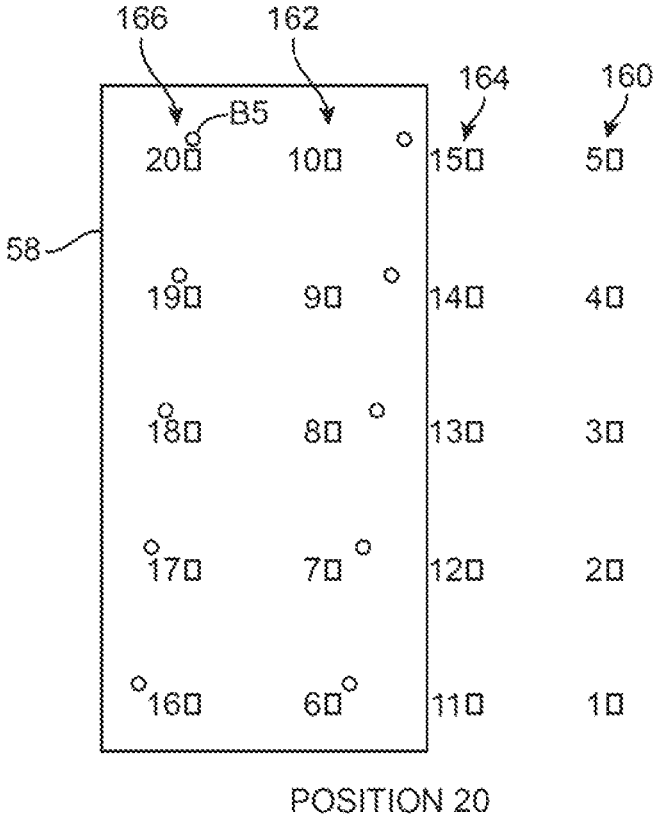

Once the pin B1 is cleared of trigger release arm for bin 10 along the second column 162, the pin A1 along the index plate 58 may readily aligned with the trigger release arm for bin 11 along the third column 164, as shown in FIG. 8I. The movement and alignment of the pins of the index plate 58 may be repeated accordingly for actuating the trigger release arms for the remaining columns 164, 166. For instance, FIG. 8J shows how pin A4 may be aligned with trigger release arm for bin 14 while further translation of index plate 58 may then align pin B5 with trigger release arm for bin 20, as shown in FIG. 8K. Hence, as illustrated by the movement of the index plate 58 relative to the matrix of bins, any lid may be actuated by the appropriate pin located upon the index plate 58 and the lids may be actuated in any sequence as needed or desired by at least one index plate.

Figure 9A:
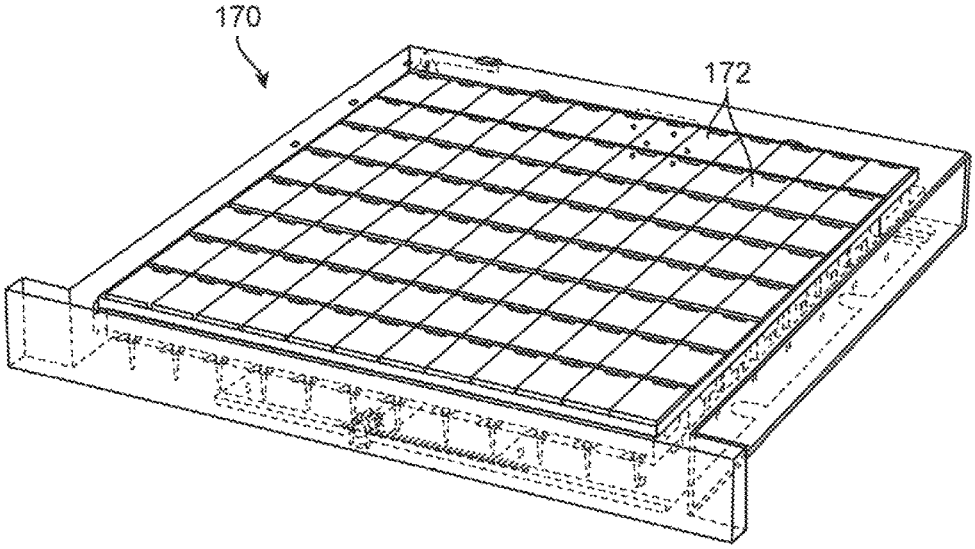
FIGS. 9A and 9B show perspective assembly and exploded views of a drawer having a relatively larger number of bins utilizing at least two separate selector index plates.

In alternative variations, the drawer may be configured to have any fewer or greater number of bins in which case the index plate may be sized and configured accordingly. In variations where a relatively greater number of bins are configured in the drawer, more than one index plate may be utilized for actuating any of the bins and in any sequence, if so desired, utilizing the position and methods described herein. FIG. 9A shows a variation of a drawer assembly 170 configured to have 96 bins 172 arranged in matrix having eight rows and twelve columns, although the bins may be arranged in any number of various configurations so long as the drawer is able to accommodate.

Figure 9B:
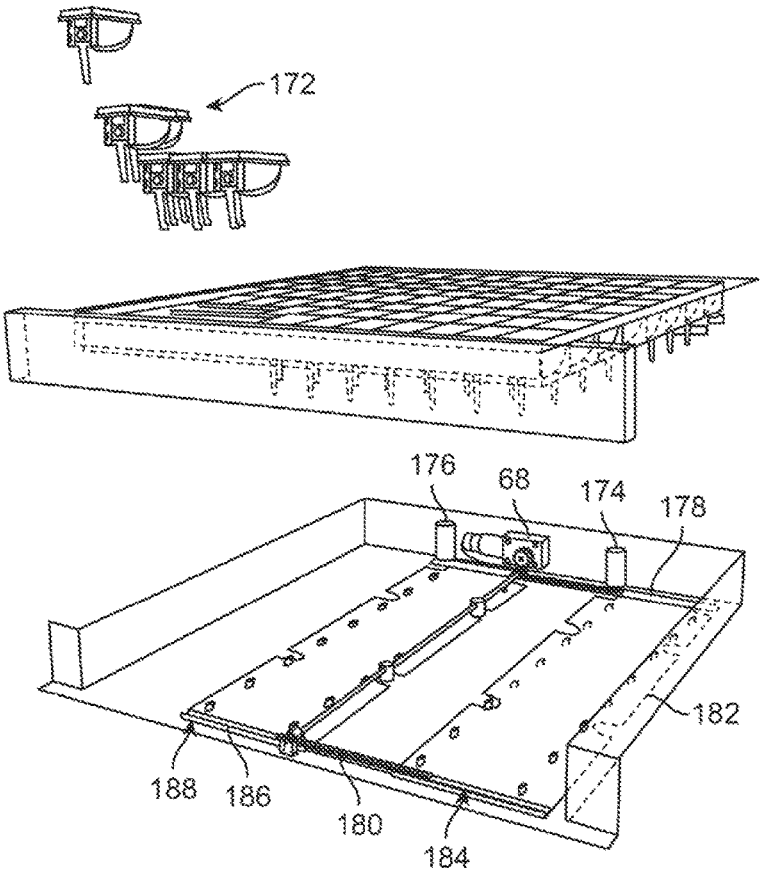

FIG. 9B shows an exploded assembly of the drawer to illustrate how two separate index plates may be used in a drawer with a relatively large number of bins. A first selector index plate 182 having pins 184 arranged in two columns may be positioned adjacent to a second selector index plate 186 similarly having pins 188 arranged in two columns Each of the index plates 182, 186 may be translated along their width by a single actuator 68 (e.g., selector motor and encoder) which rotatingly engage both index plates 182, 186 along a respective first rack 178 and second rack 180 defined along both of the index plates 182, 186. In this variation, a single rack 178, 180 along both edges of the index plates 182, 186 may allow for a single actuator 68 to translate both plates along their widths but in alternative variations, each index plate 182, 186 may instead utilize a separate actuator for driving each individual index plate. To translate each of the index plates along their length in the second direction, first release actuator 174 may be in communication with the first index plate 182 while a second release actuator 176 may be in communication with the second index plate 186. However, in alternative variations, a single release actuator engaged to both index plates 182, 186 may be used to translate each of the plates simultaneously.

While a single index plate may be utilized for actuating all the bins in the drawer assembly 170, having two separate index plates 182, 186 positioned adjacent to one another may allow for the translation of one or both plates 182, 186 to efficiently actuate individual bins. Moreover, while two separate index plates 182, 186 are shown, additional index plates may be utilized, for example, three or more index plates positioned adjacent to one another, if so desired in other variations.

Figure 10:
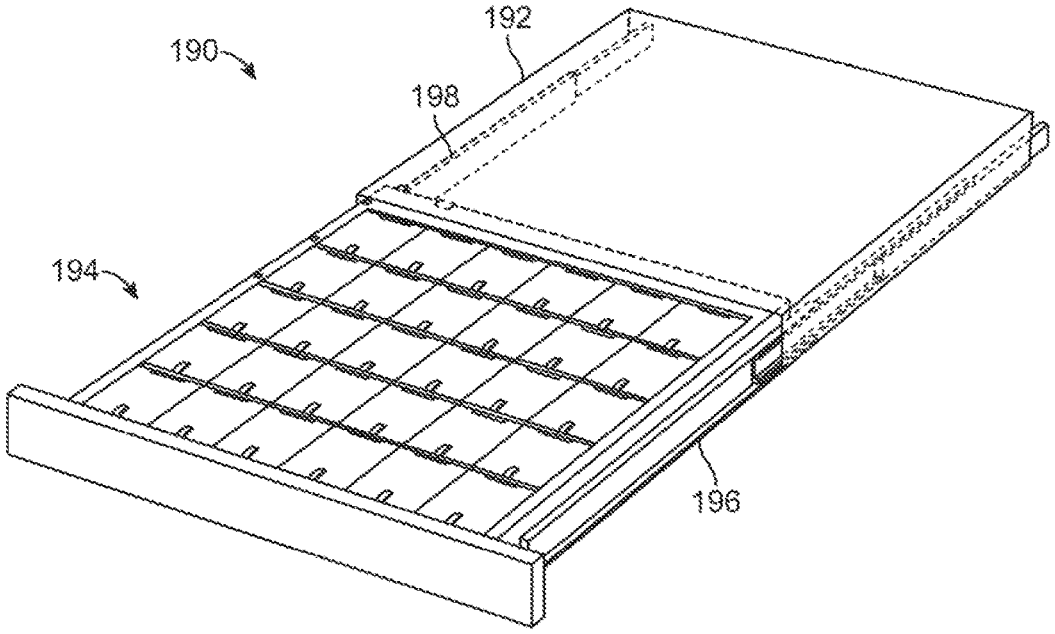
FIG. 10 shows a perspective view of yet another variation of a drawer having multiple bins with a selector index plate having an alternative configuration.

While the drawer assembly may be pulled from the cabinet in which it resides by pulling the entire drawer enclosure, variations of the drawer assembly may optionally incorporate slides which enable a portion of the drawer to be pulled out from the cabinet to access the bins. For instance, drawer assembly 190 shown in FIG. 10 illustrates an assembly having slides 196, 198 mounted on both sides of the assembly 190 such that the bin assembly 194 may be pulled separately from the drawer housing 192. This assembly may still allow for the lids on individual bins to be actuated, as described herein, and may allow for the entire drawer assembly 190 to be efficiently removed from the cabinet, if needed or desired. It is intended that this variation may be utilized with any of the index plate actuation assemblies described herein and in any combination as so desired.

Figure 11A:
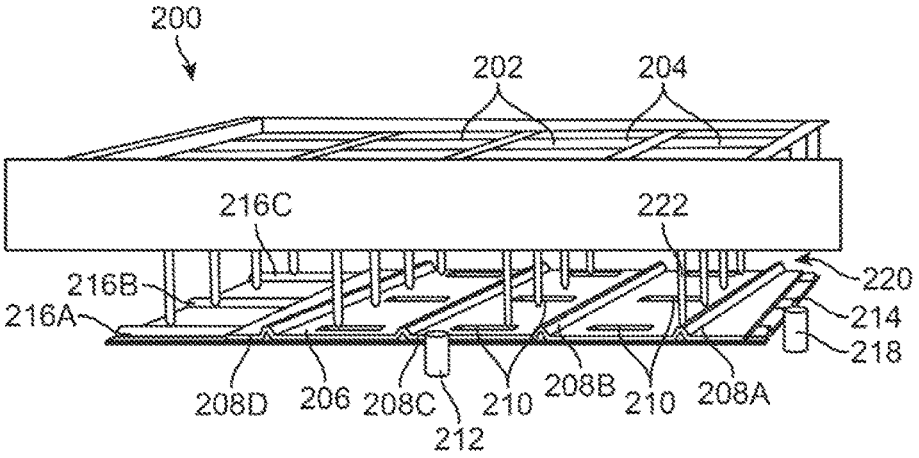
FIGS. 11A to 11C show perspective views of another variation of a selector index plate which functions as a lifter plate.
Figure 11B:
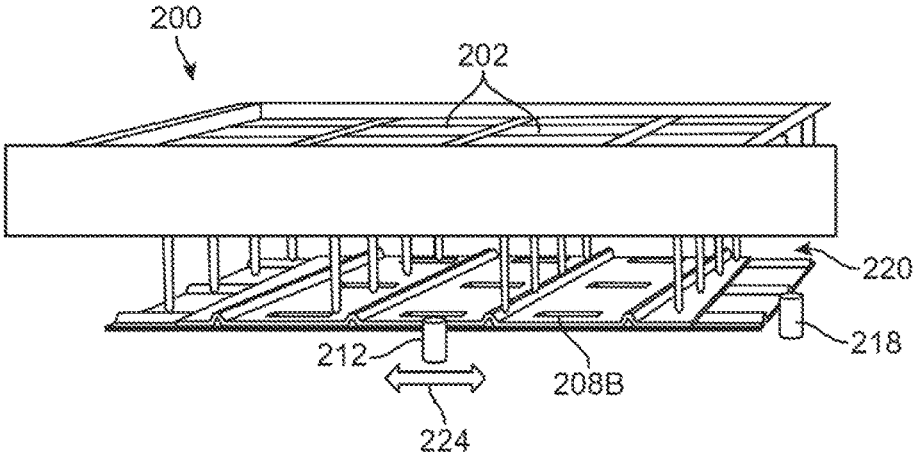
Figure 11C:
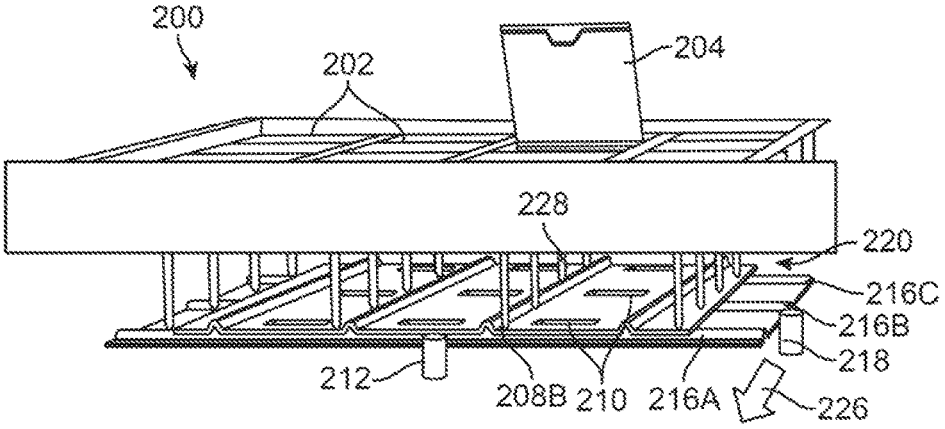

In addition to the index plate having individual pins projecting from the surface of the plate, alternative variations of the index plate may be used. For instance, FIGS. 11A to 11C show perspective views of a drawer assembly 200 having a plurality of bins 202 with their respective lids 204 locked. However, in this variation, selector index plate 206 may be configured with one or more ridges defined to form a continuous ridge along the length of the index plate 206 such that the ridges protrude from the surface of the index plate 206 rather than having individual pins. Like the pins described herein, the ridges may be formed at an angle relative to the proximal and distal edges of the index plate 206 so that the ridges form an off-set protrusion relative to the plurality of trigger release arms.

As shown in FIG. 11A, index plate 206 may have a first selector ridge 208A, second selector ridge 208B, third selector ridge 208C, and fourth selector ridge 208D forming parallel ridges which protrude from a first surface of the index plate 206 and which are each angled relative to the index plate 206. In between each of the ridges are one or more index plate ridges 210 which form ridges or protrusions which protrude from the index plate 206 from a second surface of the index plate 206 opposite to the direction of protrusion of the ridges 208A 208B, 208C, 208D. A release plate 214 may be positioned beneath the index plate 206 in close proximity to the bottom or second surface of the index plate 206 but at a distance to allow for the free and uninhibited translation of the index plate 206 relative to the release plate 214. The release plate 214 may have one or more ridges which are defined to extend along the width of the release plate 214 such that the ridges protrude from a first or top surface of the plate 214.

An example is shown where three ridges are defined along the release plate 214 including a first lifter ramp 216A, a second lifter ramp 216B, and a third lifter ramp 216C where each of the lifter ramps are defined to extend along the width of the release plate 214 and are parallel to one another. However, in other variations, the lifter ramps may be formed in other configurations which are not parallel to one another and which may vary in number. Moreover, the lifter ramps may be formed in interrupted (uniformly or otherwise) patterns rather than in a continuous ridge. While the index plate 206 is formed to have a width which less than a width of the drawer enclosure to allow its translation within the drawer, the release plate 214 may be configured to extend at least to the width of the bin matrix beneath the trigger release arms 220.

The example shown in FIG. 11A illustrates how a portion of the first ridge 208A is positioned directly beneath a trigger release arm 222. The index plate 206 may be translated along the first direction 224, as shown in FIG. 11B, to reposition the index plate 206 such that a portion of the second ridge 208B is directly beneath the trigger release arm 228, as shown in FIG. 11C. A first release actuator 212 may be positioned to be in engagement with the index plate 206 for translating the index plate 206 along a first direction 224 along a width of the index plate 206 in a manner similarly described herein while uninhibited by the trigger release arms 220 and the release plate 214. In this example, the second selector ridge 208B is translated by actuator 212 until a portion of ridge 208B aligned directly beneath a preselected trigger release arm 228 which is engaged with the lid 204. A second release actuator 218 engaged with the release plate 214 may be configured to translate the release plate 214 along its length as indicated by the release plate translation 226 such that the one or more lifter ramps 216A, 216B, 216C may abut against the one or more index plate ridges 210. This contact by the release plate 214 may cause the index plate 206 to lift away from the release plate 214. Because the portion of ridge 208B is aligned directly beneath the trigger release arm 228, the ridge 208B may come into contact and lift the arm 228 to cause the lid 204 to unlock enabling the lid to be opened. Because of the angle at which each of the ridges 208A, 208B, 208C, 208D are aligned and because of their spacing from one another and relative to the spacing between the trigger release arms 220, the remaining trigger release arms may be un-actuated such that the non-selected lids remain in their locked configuration.

Figure 12:
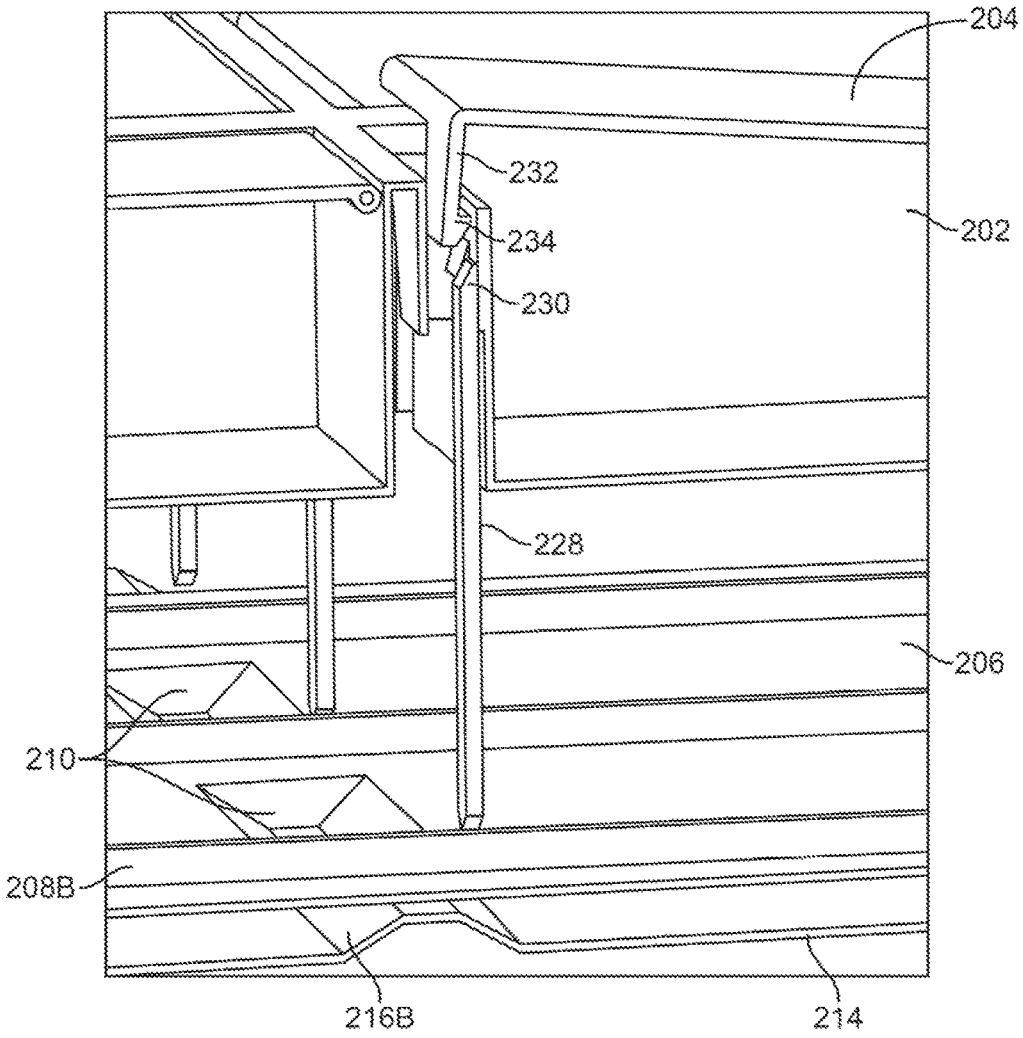
FIG. 12 shows a detail perspective view of an example of the lifter plate selectively unlocking a bin.

FIG. 12 shows a partial cross-sectional view of the interaction between the index plate 206, release plate 214, and trigger release arm 228. As described above, once the index plate 206 has been translated to align the ridge 208B beneath the pre-selected bin 202 and trigger release arm 228, the release plate 214 may be translated such that the one or more lifter ramps 216A, 216B, 216C may abut against the one or more index plate ridges 210. Because the lifter ramps and plate ridges protrude in opposite directions, the interference between the two may urge the index plate 206 to lift up and away from the release plate 214. The portion of the ridge 208B may contact and lift the trigger release arm 228 (while the remaining release arms are untouched) where a locking pin distal end 230 may urge the latch 234 of trigger arm latch 232 to release from the bin 202 and allow the lid 204 to open. This particular variation is illustrated as an example and other release mechanisms may accordingly be used and are intended to be within the scope of this disclosure.

Regardless of the variation of the index plate used, one or more sensors may be incorporated with each of the bins (or at least one bin) to indicate to the controller that a lid has been opened either intentionally from a pre-selected bin or unintentionally. These sensors may function independently of the index plate operation or they may function in conjunction with the index plate positioning. In the event that a lid from a pre-selected bin is opened, the sensor detecting the opened lid may serve as confirmation to the controller that the appropriate lid has been opened. In the event that one or more lids from non-selected bins are opened (unintentionally or unauthorized), the sensors may serve as an indicator of non-authorized access to the non-selected bins.

Figure 13A:
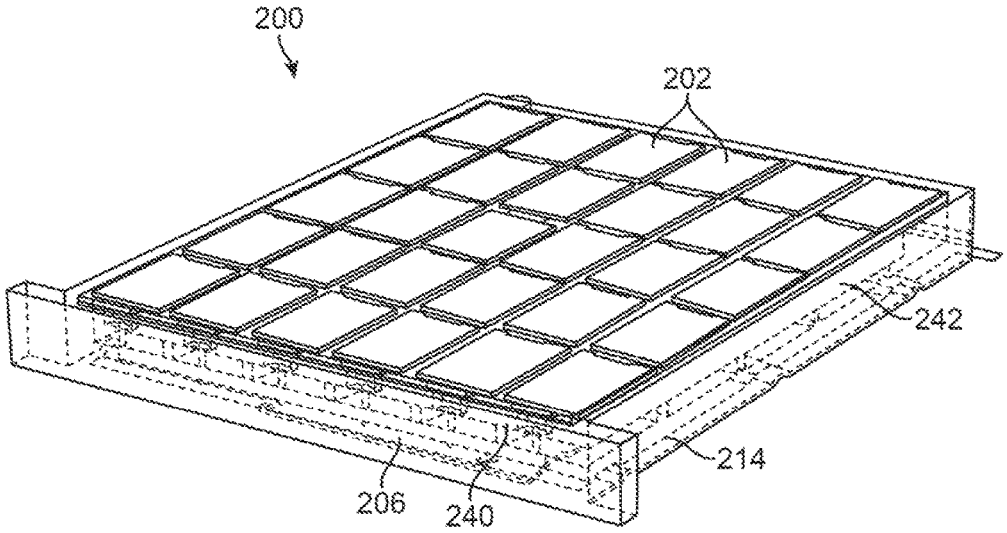
FIGS. 13A and 13B show perspective assembly views of a drawer having a lifter plate.
Figure 13B:
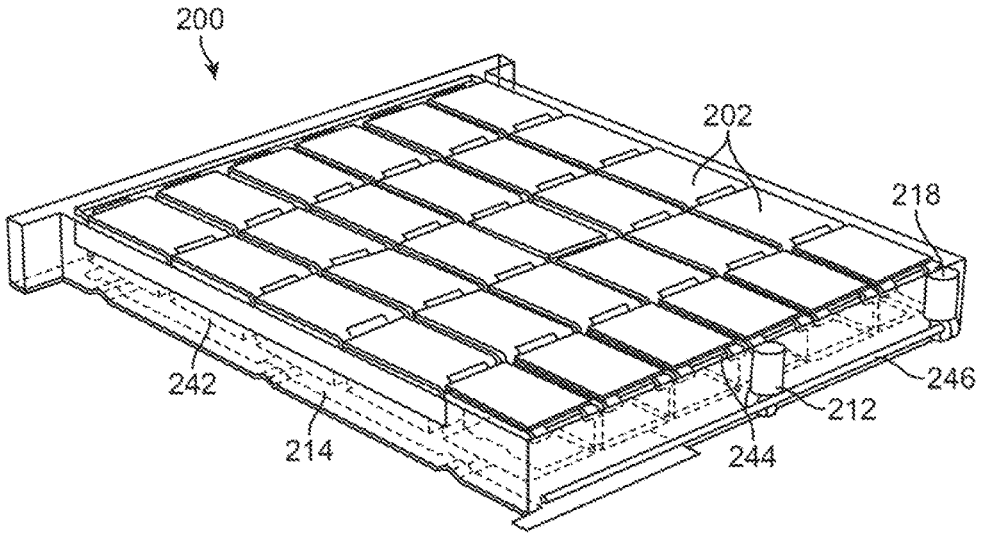

In either case, one or more sensor grids 240, e.g., capacitive sensor grids integrated on PCBs, may be incorporated into the drawer assembly 200, as shown in the perspective views of FIGS. 13A and 13B, which illustrate one variation. The sensor grids 240 may be one or more sensors 244, e.g., optical detector, positioned along the grid 240 at locations which correspond to each bin (or at least one bin) release mechanism. Each row or column of the bin matrix may have a corresponding sensor grid 240 extending along the corresponding row or column and at least one interconnecting bus or connector 242, e.g., drawer open detector and interconnect PCB, may extend along the length or width of the bin matrix for connection to each of the sensor grids.

Figure 14:
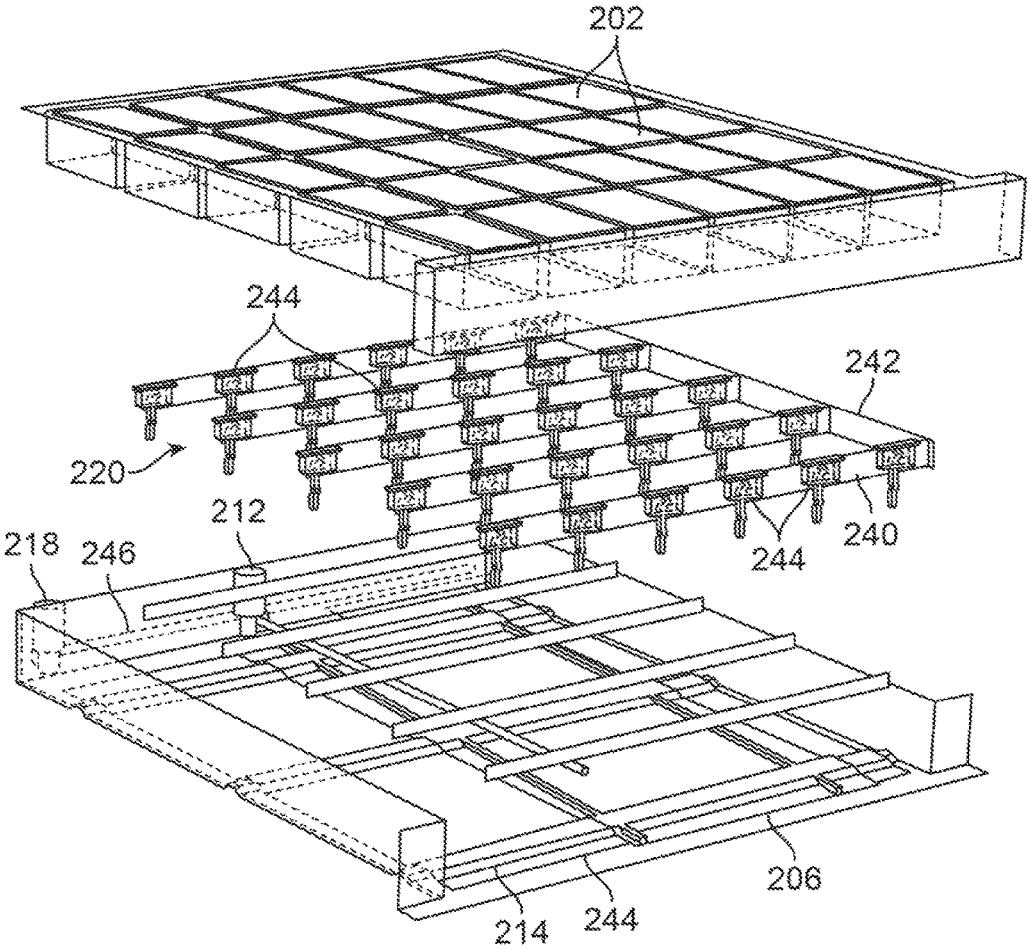
FIG. 14 shows a perspective exploded view of the drawer and lifter plate assembly.

An example is shown in the exploded assembly view of FIG. 14 which illustrates the bin matrix and one variation for how the individual sensor grids 240 may be aligned relative to the bin matrix. Each of the sensor grids 240 may be electrically coupled to the interconnecting bus or connector 242 which in turn may be electrically coupled or in electrical communication with the controller. Release mechanisms for each of the trigger release arms 220 is shown and their relation with each of the sensors 244.

Figure 15:
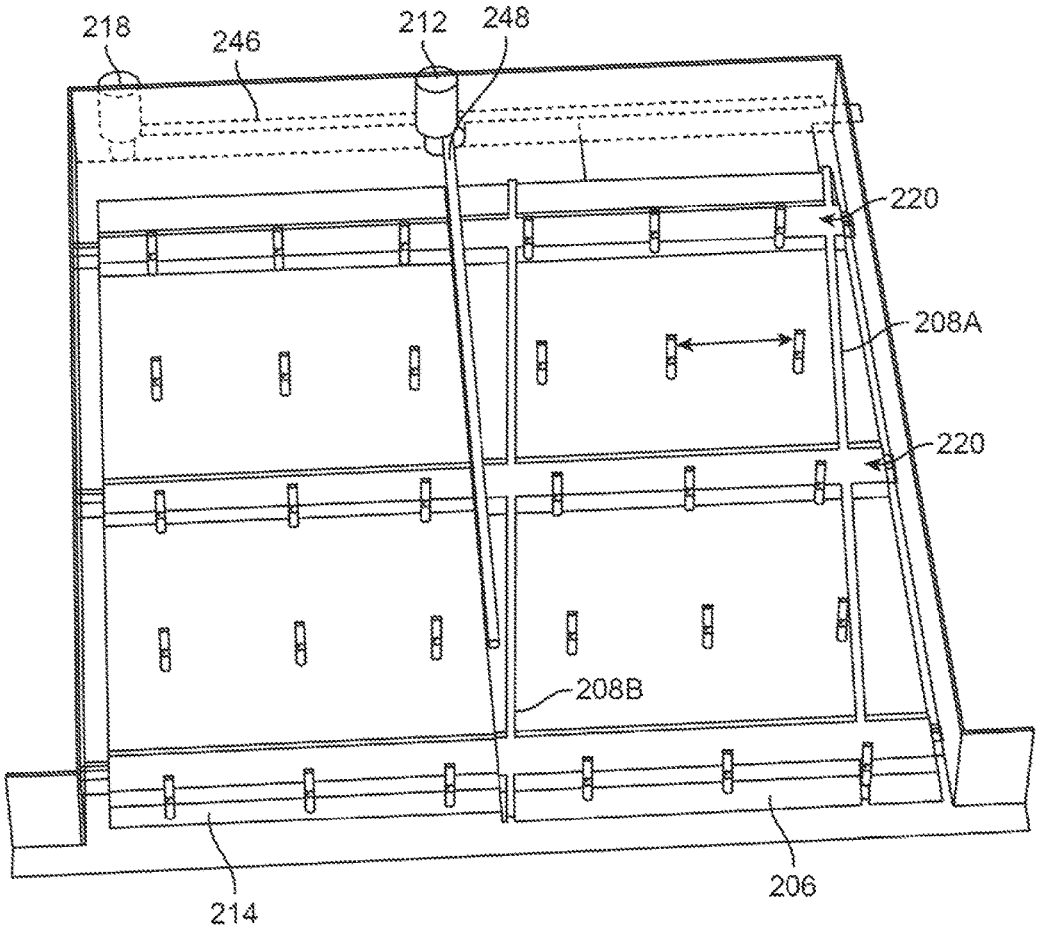
FIG. 15 shows a perspective view of one variation illustrate a lifter plate and selector plate.

FIG. 15 shows another example of the lifter plate variation with the bins removed for clarity. The first release actuator 212 may be seen having a drive shaft 248 rotatingly attached to the actuator 212 and extending over the index plate 206 for translating index plate 206 along its width. The second release actuator 218 may also be seen having a drive shaft 246 extending along the rear of the enclosure for translating the release plate 214. The first and second release actuators 212, 218 are shown as being mounted near the rear of the drawer enclosure but they may be mounted at various locations within the drawer assembly. The pins 220 are also shown to illustrate their relative positioning to one another as well as with respect to the ridges defined at an angle along the index plate 206. Even with the index plate 206 having a relatively shorter width, the ridges allow for a relatively faster travel time of the index plate 206 and release of the pre-selected bin.

Figure 16A:
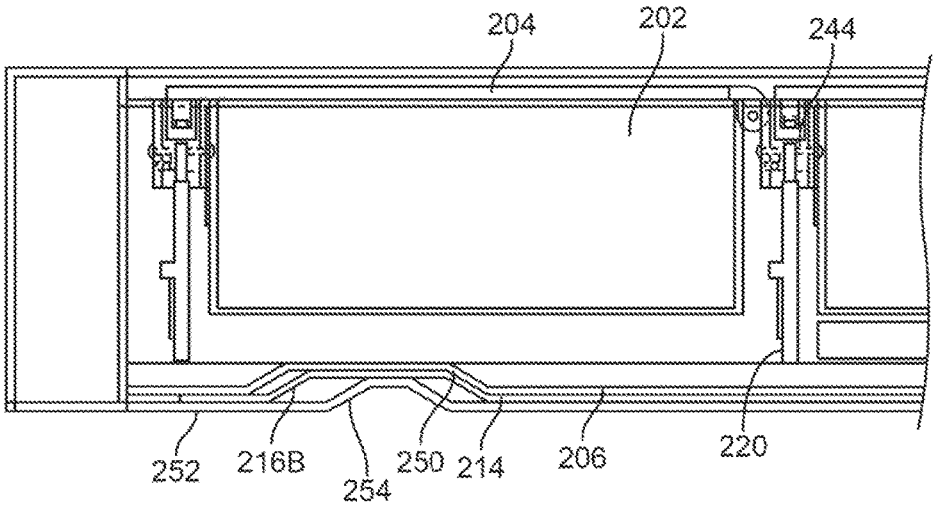
FIGS. 16A and 16B show side views illustrating how the lifter plate and selector plate may be actuated to selectively unlock a lid from a bin.
Figure 16B:
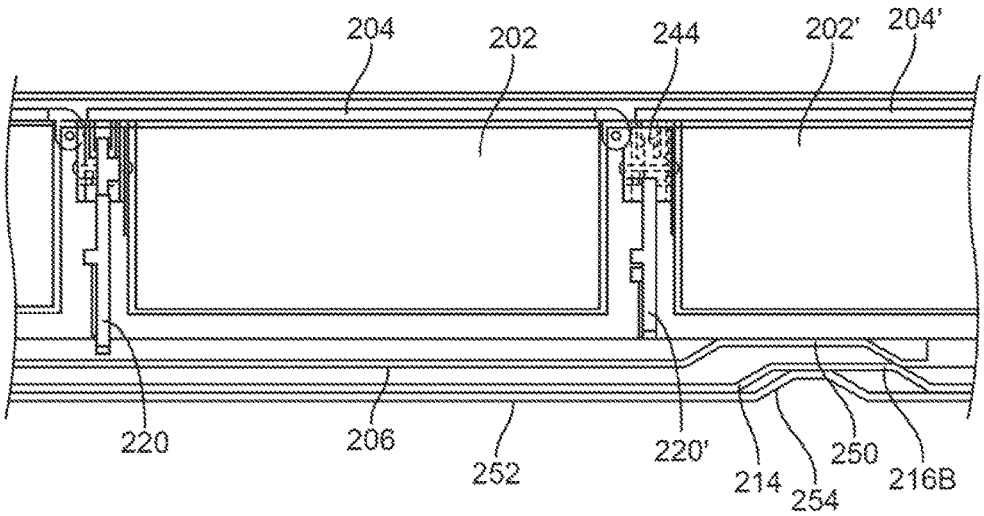

FIGS. 16A and 16B show cross-sectional side views of another variation of the release plate assembly. In this example, the drawer enclosure is shown as having a height of, e.g., 2.85 in., with the individual bins having a height of, e.g., 1.75 in. The index plate 206 may be seen having a lifter interface 250 and the release plate 214 having a lifter ramp 216B. The bottom enclosure 252 may also define a secondary ramp 254. In this variation, both the index plate 206 and release plate 214 may have their respective lifter interface 250 and lifter ramp 216B protruding in the same direction such that the lifter ramp 216B may nest within the lifter interface 250. The secondary ramp 254 may also nest within the lifter ramp 216B. As the release plate 214 is actuated, as shown in FIG. 16B, the lifter ramp 216B may interfere with the interior surface of the lifter interface 250 causing the index plate 206 to lift away from the release plate 214 and into contact against a pre-selected trigger release arm 220' to release the lid 204' of a pre-selected bin 202'. As previously described, the remaining trigger release arms 220 may remain unaffected leaving their respective lids in a locked configuration.

Figure 17A:
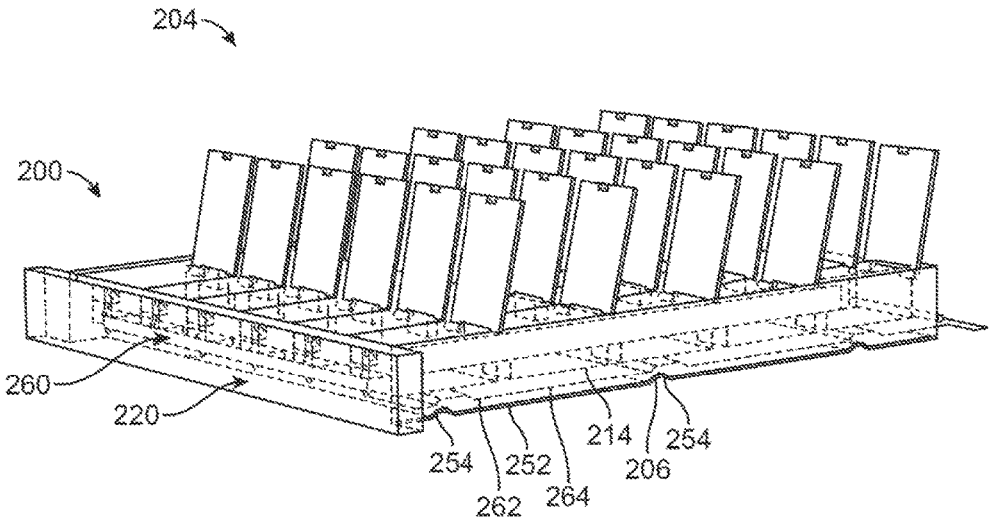
FIGS. 17A and 17B show perspective views of how the lifter plate and selector plate may be actuated to release each of the locked lids.
Figure 17B:
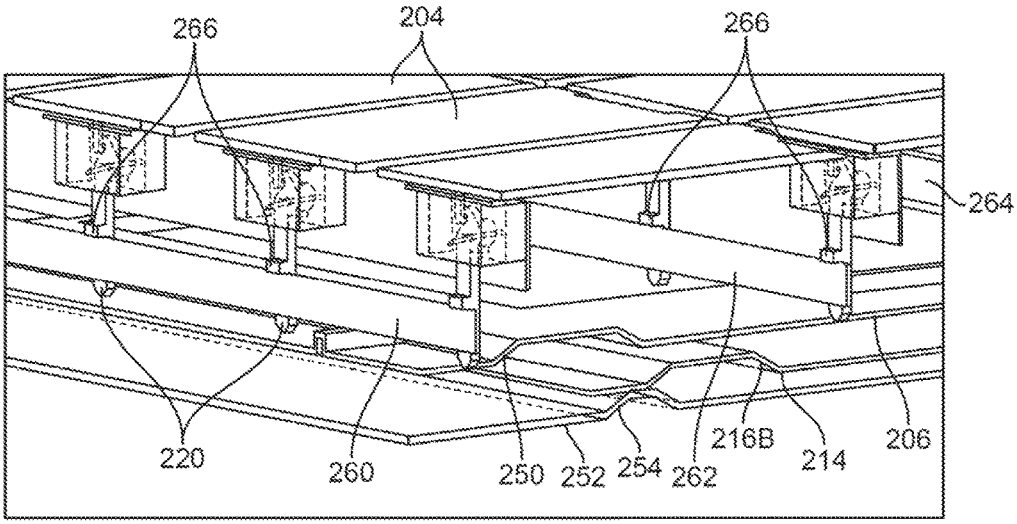

With such a configuration, the release plate 214 may be actuated to release more than one lid 204 simultaneously. As shown in the perspective view of FIG. 17A and the detail view of FIG. 17B, in the event that more than one lid 204 requires release, the release plate 214 may be actuated to overdrive such that the release plate 214 is translated such that the lifter ramp 216B extends past the secondary ramp 254 of the bottom enclosure 252 and also past the lifter interface 250 of the index plate 206. This results in the release plate 214 lifting away from the bottom enclosure 252 and further lifting the index plate 206 higher than it would normally lift away from the release plate 214 and from the bottom enclosure 252. The ridge 208B defined along the index plate 206 may come into contact against one or more lifter bars which may extend across each of the trigger release arms which in turn may actuate each of the trigger release arms to unlatch each of the lids. As shown in FIG. 17B, a first lifter bar 260 may extend across a first row of trigger release arms, a second lifter bar 262 may extend across of second row, a third lifter bar 264 may extend across a third row, and so on. Each of the trigger release arms 220 may be seen as having a stop 266 which protrudes from the arms and functions as a stop to engage the respective lifter bars. As the index plate 206 is lifted, the lifter bars 260, 262, 264 may engage the stops 266 to urge each of the trigger release arms to actuate and release the respective lids. In other variations, only a partial number or a selected number of the trigger release arms may define a stop such that actuation of the lifter bars may only release a pre-selected number of the lids from the bins.

Figure 18:
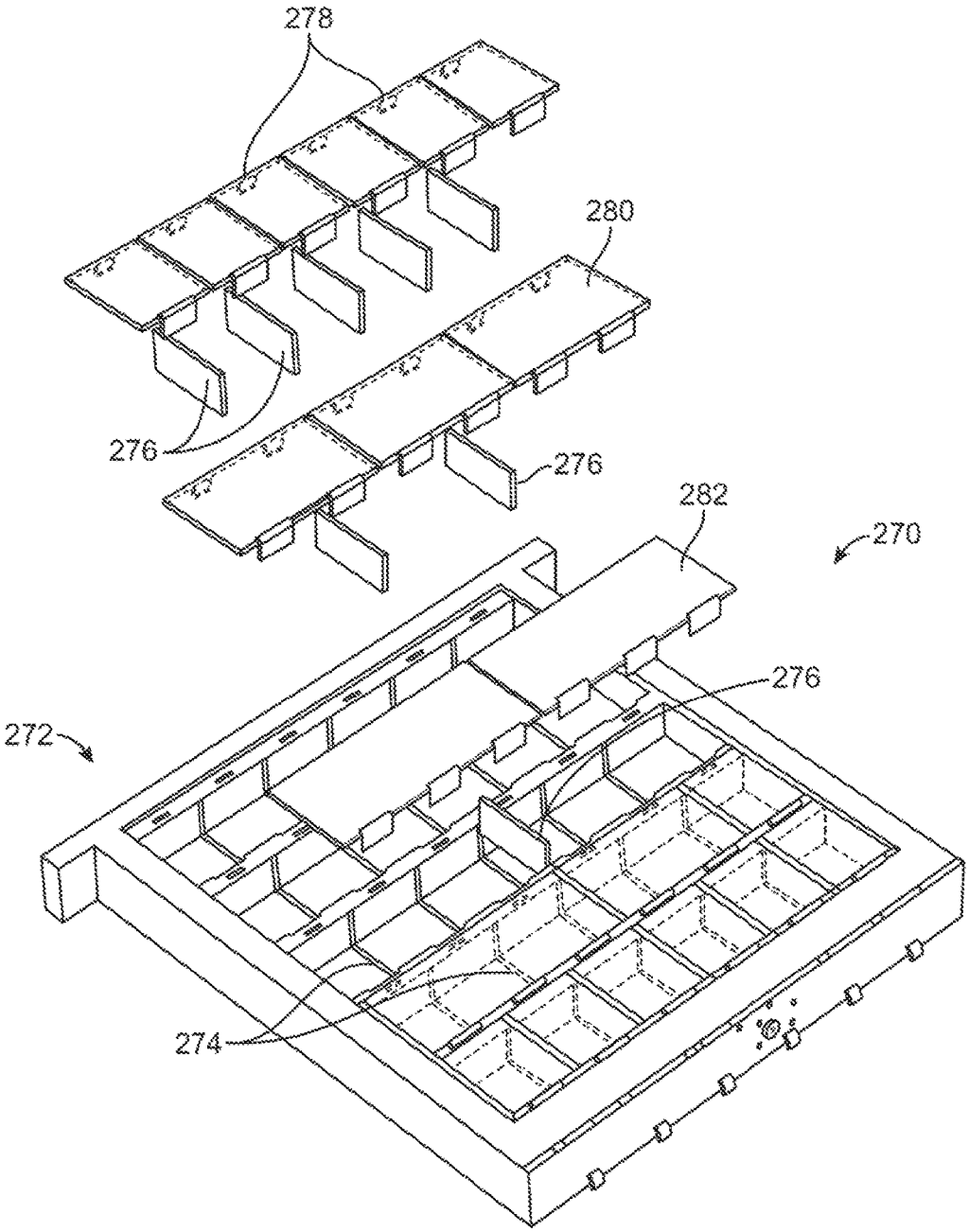
FIG. 18 shows a perspective exploded view of how the drawer may be reconfigured into bins of different sizes regardless of the lid actuation mechanism.

Turning now to FIG. 18, various configurations of the bins are illustrated. These variably sized bins may be optionally sized in any number of different configurations and regardless of the bin size or configuration, it is intended that any of the index plate variations (including one or more index plate configurations) may be utilized in any combination with these variably sized bin configurations. One variation is shown in the exploded assembly of drawer assembly 270 which has variably configurable bins of different sizes and shapes. The bins may be individually formed into separate assemblies which are arranged in the bin matrix array 272 or they may be formed as continuous chambers which extend along the width of the drawer tray and which may be divided into individual bins by the positioning of dividers 276 within selected divider slots 274. Depending upon the formed bin configuration, a lid of appropriate size may be secured to cover the divided bin. Examples of various lid sizes for accommodating different size bins are shown where lids 278 may have a first size for a standard bin size, lids 280 may have a second size which are double the size of the standard bin, and lids 282 may have a third size which are triple the size of the standard bin. Each of the lids 278, 280, 282, regardless of its size, may utilize a single latch to securely cover the bin and regardless of the bin size and any of the index plate variations described herein may be utilized with any bin size configuration. The controller may be programmed accordingly to actuate the appropriate lid. The example shown in the figure is intended to be illustrative of the various bin configurations. Other variations may utilize any number of bin sizes and configurations and are intended to be within the scope of this disclosure.

Figure 19A:
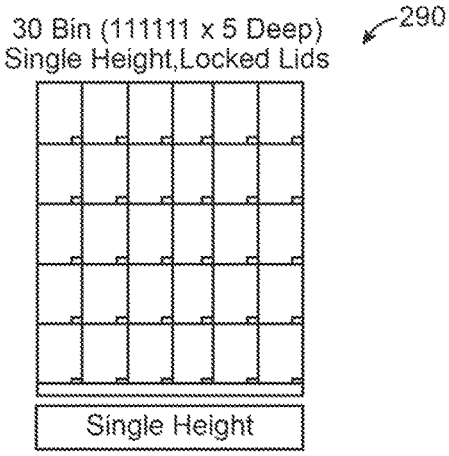
FIGS. 19A to 19E show schematic illustrations of some examples of how the various sized bins may be configured regardless of the lid actuation mechanism.
Figure 19B:
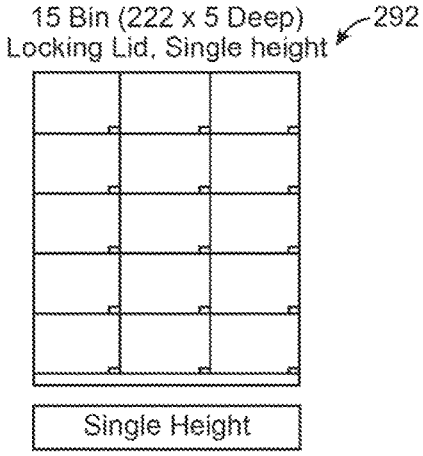
Figure 19C:
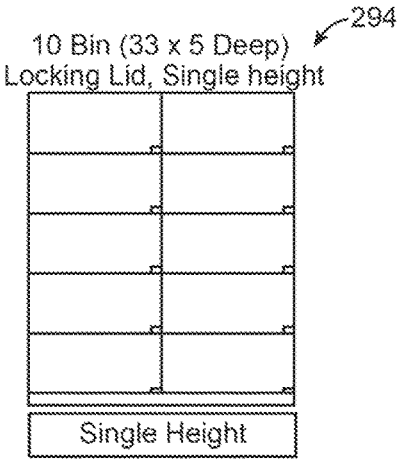
Figure 19D:
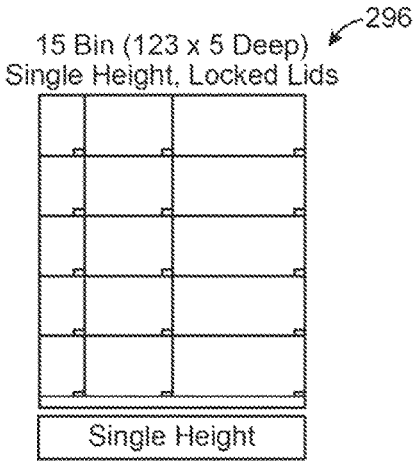
Figure 19E:
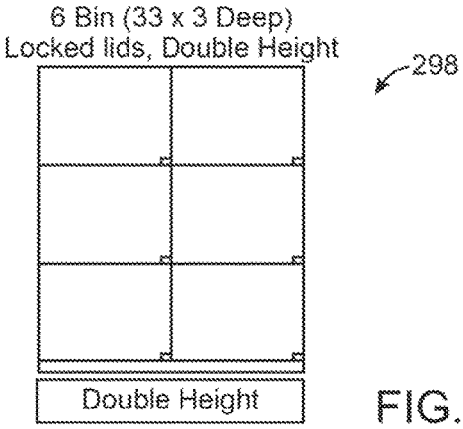

To illustrate the various bin configurations which may be used herein, FIGS. 19A to 19E show schematic variations of some examples. FIG. 19A shows an example of a standard bin configuration 290 having 30 bins. FIG. 19B shows another example of a bin configuration 292 having 15 bins where each bin is sized in width to be double the standard bin configuration. FIG. 19C shows a bin configuration 294 having 10 bins where each bin is sized in width to be triple the standard bin configuration. FIG. 19D shows another example of a bin configuration 296 having 15 bins including standard width bins, double width bins, and triple width bins as well. Each of the variations may be sized to be a single height of the standard bin configuration while the variation shown in FIG. 19E illustrates a bin configuration 298 having 6 bins where each bin is triple the width and also double the height of the standard bin configuration. These examples are intended to be illustrative of the various bin configurations and are not intended to be exhaustive. Accordingly, any of these bin configurations may be used in any combination as practicable and any of these bin combinations are intended to be used with any of the index plate variations described herein.

Figure 20:
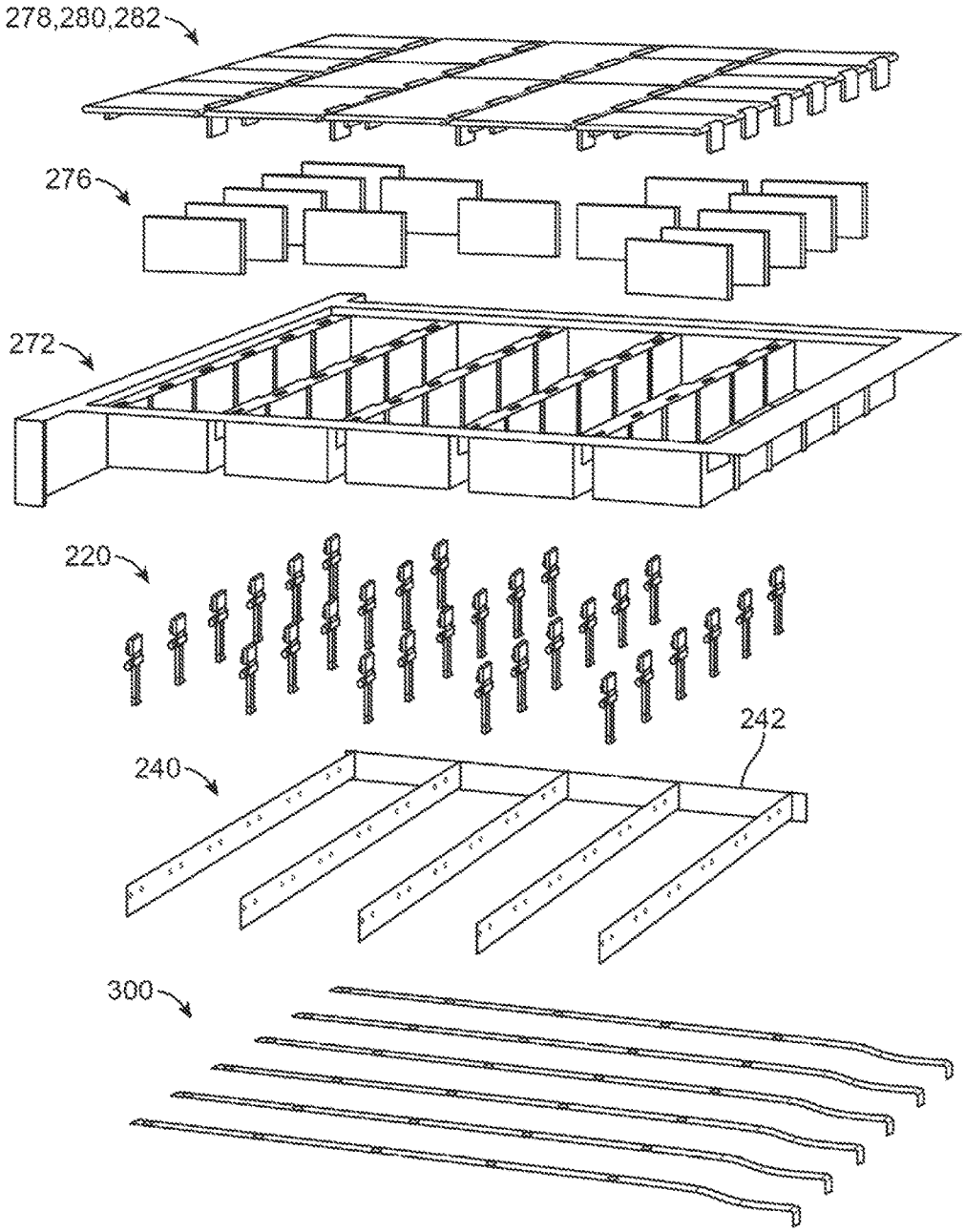
FIG. 20 shows a perspective exploded view of how different size lids may be utilized within a drawer regardless of the lid actuation mechanism.

FIG. 20 shows an exploded assembly view of the bin matrix array 272 having the dividers 276 and variably sized lids 278, 280, 282 as well as the trigger release arms 220 and sensor grids 240 electrically coupled to the interconnecting bus or connector 242. One or more optional release actuators 300 may also be incorporated into the drawer assembly to allow for the manual override release of one or more of the lids. These release actuators 300 may extend through the drawer assembly and release one or more of the trigger release arms 220 by manual actuation, if so desired.

Figure 21A:
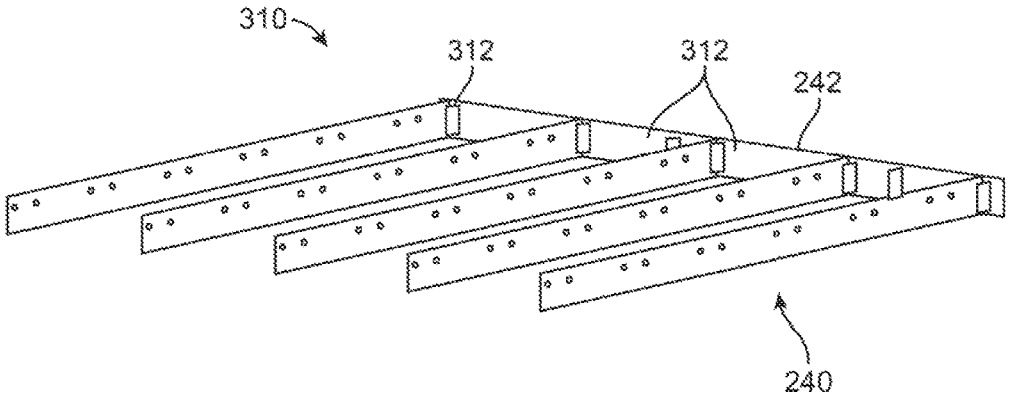
FIGS. 21A and 21B show perspective views of sensor board configurations which may be integrated within the drawers.
Figure 21B:
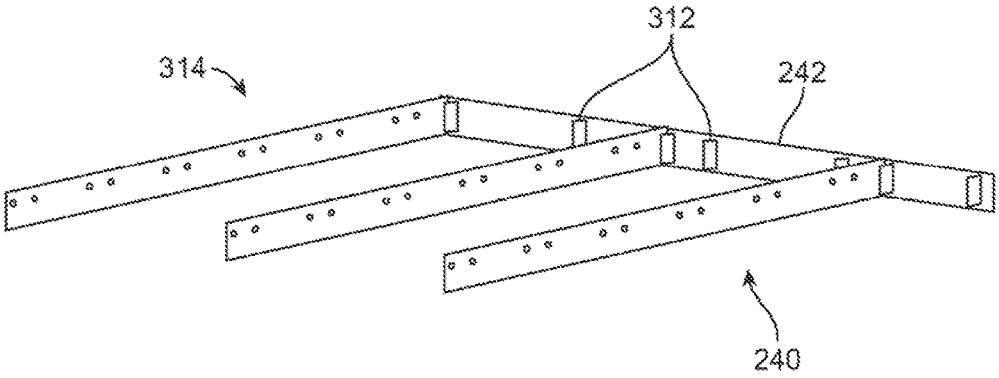

To accommodate the variably configured bin arrangement, the number and arrangement of sensor grids 240 may also be varied accordingly. The configuration shown in the perspective view of FIG. 21A shows a detector grid assembly 310 configured for a five row detector grid pattern to accommodate five rows of bins. Each of the sensor grids 240 may be connected to the interconnecting bus or connector 242 via connectors 312. If the bin configurations are altered, the number and positioning of the sensor grids 240 may be altered accordingly. An example is shown in the perspective view of FIG. 21B which shows how the positioning and number of sensor grids 240 may be changed to accommodate the changing configuration of the bin array. In this variation, the detector grid assembly 314 has been configured in a three row detector grid pattern although the sensor grids 240 may be configured in any number of other variations, as needed or desired.

Figure 22:
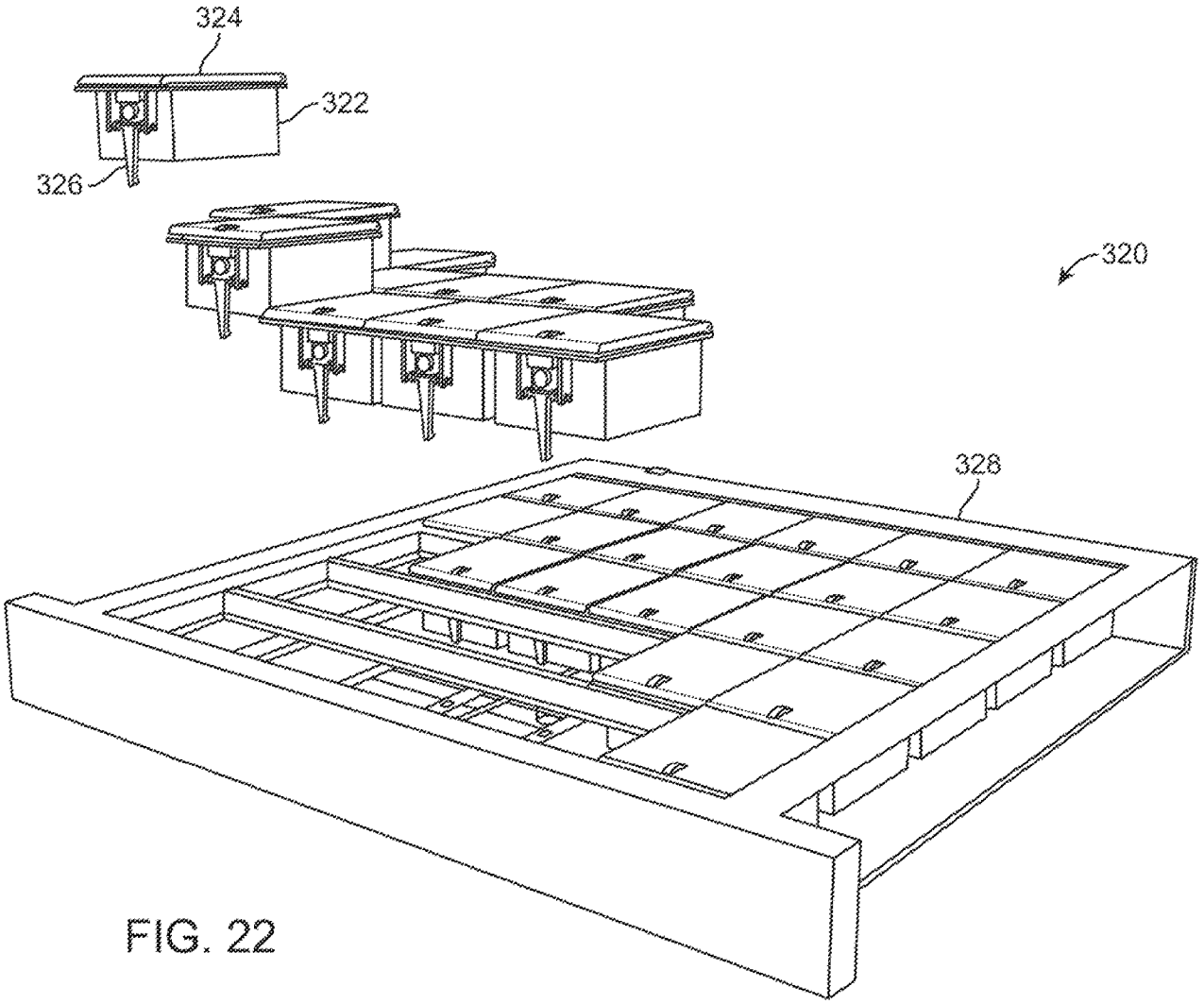
FIG. 22 shows a perspective assembly view of drawer having multiple bins aligned along the sensor boards.

In yet another variation, FIG. 22 shows an exploded perspective view of a drawer assembly 320 having separately molded bins 322 each having a lid 324 and trigger release arm 326 which are individually securable in the assembly 320, e.g., such as by snapping the bin assembly in place within the drawer 328. This variation may allow for alternative bin array arrangements where the drawer assembly 320 may incorporate individual bin assemblies which are arranged in any number of configurations. Additionally, this variation may allow for the removal and/or insertion of individual bin assemblies from the drawer without having to remove the entire drawer.

Figure 23A:
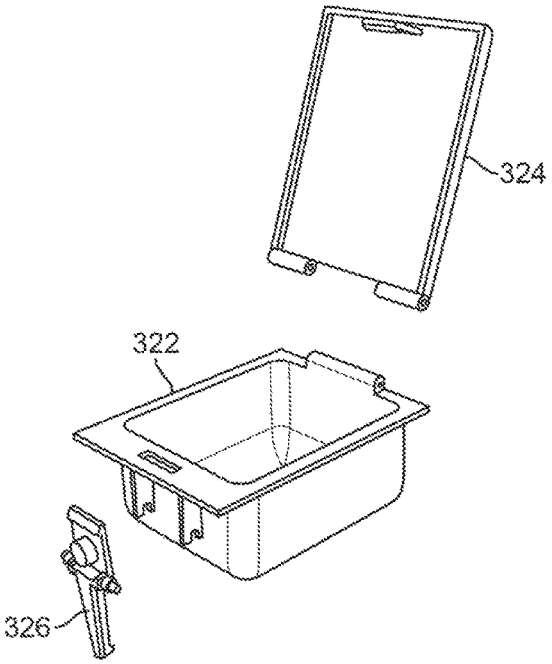
FIGS. 23A and 23B show perspective views of a bin assembly.
Figure 23B:
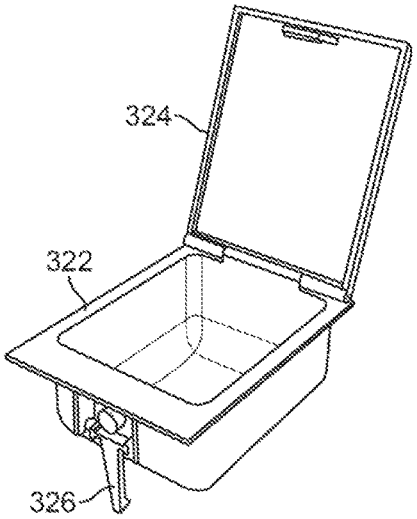
Figure 24:
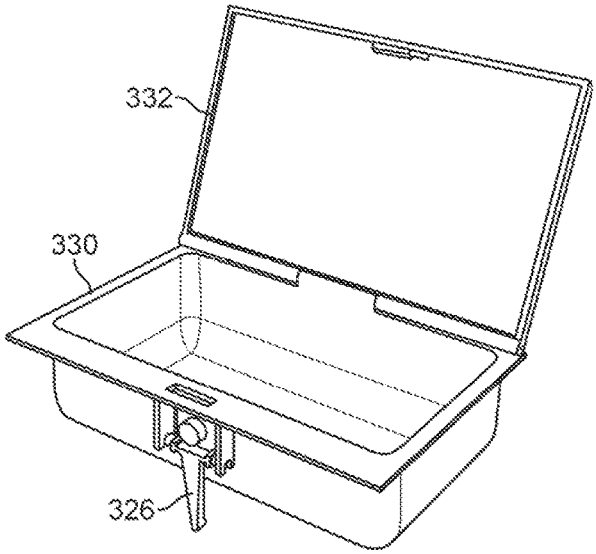
FIG. 24 shows a perspective view of an alternative variation of a bin configuration.

FIGS. 23A and 23B show perspective views of one example of an individually molded bin 322 and it corresponding lid 324. The trigger release arm 326 may be coupled directly to the molded bin 322 in this variation. FIG. 24 shows another variation of a bin 330 having a lid 332 and trigger release arm 326 where the bin 330 has a relatively larger configuration. Alternative sizes and shapes of the bin may of course be utilized.

Figure 25:
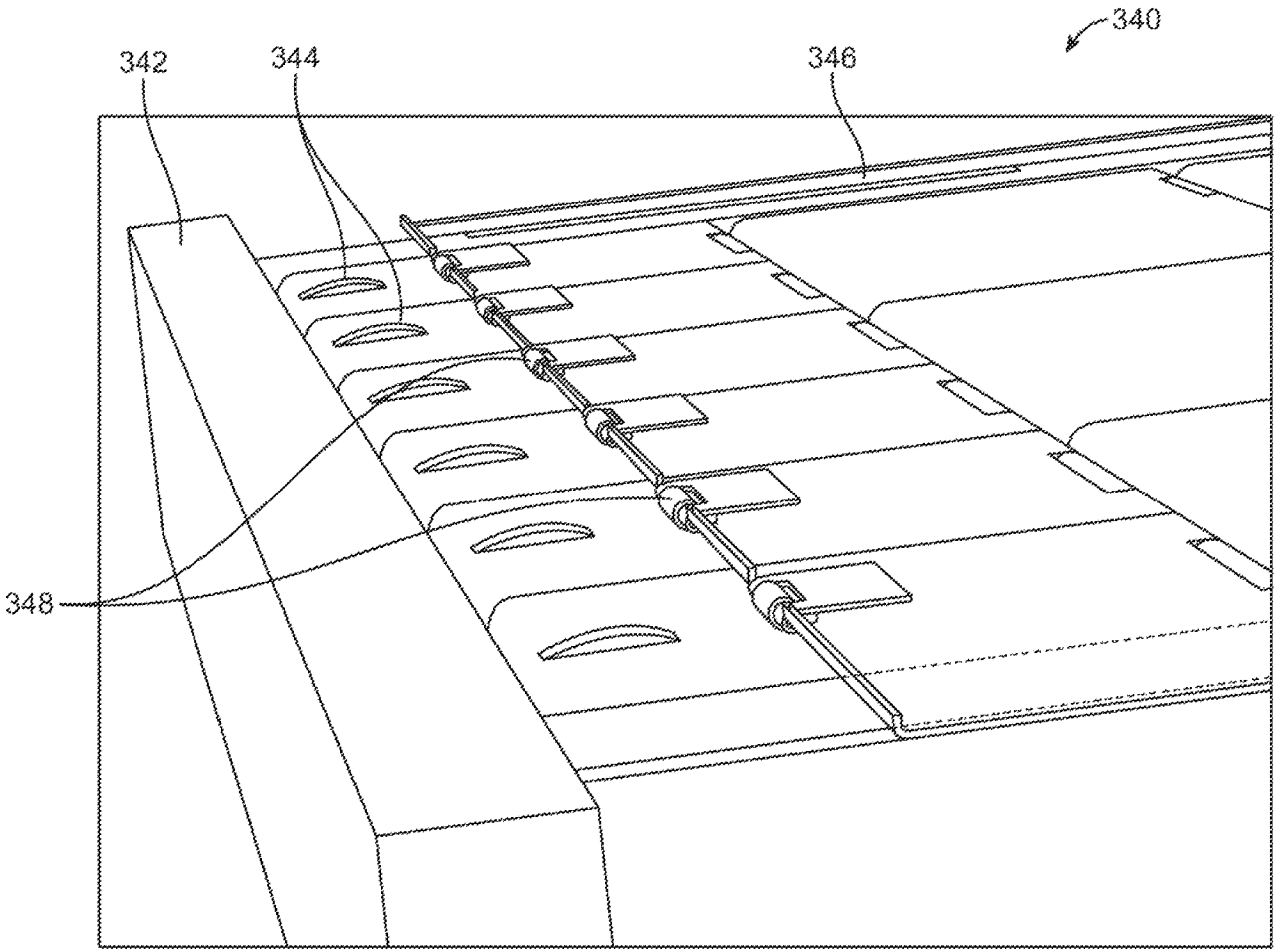
FIG. 25 shows a perspective view of a variation of a drawer configured to have self-closing lids.

FIG. 25 shows a perspective view of another optional variation of a drawer assembly 340 having self-closing lids 344. The drawer 342 may incorporate a closing mechanism 346 such as a plate or shelf having one or more rollers 348 incorporated along its distal edge. If one or more lids 344 were in an open configuration, closing the drawer 342 relative to the closing mechanism 346 may force the lids 344 to close shut automatically.

This variation and any of the different features described are intended to be utilized in any number of combinations with the different index plate variations. For instance, the drawer assembly 320 may be utilized with the detector grid assembly 310 to have various bin configurations. Such a configuration may incorporate any of the index plate assemblies described herein. While such a combination is intended to be illustrative, other such combinations are expressly intended to be within the scope of this disclosure.

The applications of the devices and methods discussed above are not limited to cabinets for the controlled release of items such as pharmaceuticals but may include any number of further applications. Modification of the above-described assemblies and methods for carrying out the invention, combinations between different variations as practicable, and variations of aspects of the invention that are obvious to those of skill in the art are intended to be within the scope of the claims.

What is claimed is:

1. An apparatus for selective actuation, comprising:

an index plate defining a plane and having a plurality of protrusions entirely within a boundary of the plate, where the boundary defines a border of the plate and wherein the plurality of protrusions are extending from a surface of the plate such that the plurality of protrusions are non-planar relative to the index plate;

a first actuator configured to translate the plate in a first direction;

a second actuator configured to translate the plate in a second direction transverse relative to the first direction;

a plurality of bins arranged relative to one another and each having a corresponding trigger release arm in proximity to the index plate for actuation by the plurality of protrusions, wherein the plurality of protrusions define one or more rows which are arranged upon the plate in a collinear arrangement, and wherein the plurality of protrusions further define a plurality of columns which are arranged upon the plate at an angle relative to a proximal or distal edge of the plate such that each protrusion is off-set relative to an adjacent protrusion along the columns.

2. The apparatus of claim 1 further comprising one or more bins arranged relative to one another and each having a corresponding trigger release arm in proximity to the index plate.

3. The apparatus of claim 2 further comprising an enclosure which the index plate and the plurality of bins are secured.

4. The apparatus of claim 2 wherein each of the plurality of bins comprise a lid which is released via actuation of the trigger release arm.

5. The apparatus of claim 2 wherein a distance between the plurality of columns of protrusions is less than a distance between adjacent columns of the trigger release arm.

6. The apparatus of claim 1 wherein the one or more columns of protrusions are arranged to actuate alternating columns of the plurality of bins.

7. The apparatus of claim 2 further comprising a sensor in communication with each of the plurality of bins.

8. The apparatus of claim 1 wherein the plurality of protrusions form pins extending from the surface of the plate.

9. The apparatus of claim 1 wherein the first actuator is engaged to the plate via a rotatable engagement.

10. The apparatus of claim 1 wherein the second actuator is slidingly coupled to the plate.

11. The apparatus of claim 1 wherein the plurality of rows are arranged collinearly along the first direction.

12. The apparatus of claim 1 further comprising a second index plate slidingly positioned adjacent to the index plate, the second index plate having a plurality of additional protrusions extending from a surface of the second index plate.

13. The apparatus of claim 1 further comprising a controller in communication with the first and second actuators.

14. An apparatus for selective actuation, comprising:

a plurality bins arranged relative to one another and each having a corresponding trigger release arm;

an index plate positioned in proximity to the plurality bins, the index plate defining a plane and having a plurality of protrusions entirely within a boundary of the plate, where the boundary of the plate defines a border of the plate, and wherein the plurality of protrusions are and extending from a surface of the plate such that the plurality of protrusions are non-planar relative to the index plate, wherein the plurality of bins are in proximity to the index plate for actuation by the plurality of protrusions;

a first actuator configured to translate the plate in a first direction;

a second actuator configured to translate the plate in a second direction transverse relative to the first direction, wherein the plurality of protrusions define a plurality rows which are arranged upon the plate in a collinear arrangement such that selective translation of the plate along the first direction aligns a single protrusion to a single trigger release arm, and wherein the plurality of protrusions further define a plurality columns which are arranged upon the plate at an angle relative to a proximal or distal edge of the plate such that each protrusion is off-set relative to an adjacent protrusion along the plurality of column such that selective translation of the plate along the second direction engages the single protrusion with the single trigger release arm.

15. The apparatus of claim 14 further comprising an enclosure which the index plate and the plurality of bins are secured.

16. The apparatus of claim 14 wherein each of the plurality of bins comprise a lid which is released via actuation of the trigger release arm.

17. The apparatus of claim 14 wherein a distance between the plurality of columns of protrusions is less than a distance between adjacent columns of the trigger release arm.

18. The apparatus of claim 14 wherein the plurality of columns of protrusions are arranged to actuate alternating columns of the plurality of bins.

19. The apparatus of claim 14 further comprising a sensor in communication with the lid of each of the plurality of bins.

20. The apparatus of claim 14 wherein the plurality of protrusions form pins extending from the surface of the plate.

21. The apparatus of claim 14 wherein the first actuator is engaged to the plate via a rotatable engagement.

22. The apparatus of claim 14 wherein the second actuator is slidingly coupled to the plate.

23. The apparatus of claim 14 wherein the plurality of rows are arranged collinearly along the first direction.

24. The apparatus of claim 14 further comprising a second index plate slidingly positioned adjacent to the index plate, the second index plate having a plurality of additional protrusions extending from a surface of the second index plate.

25. The apparatus of claim 14 further comprising a controller in communication with the first and second actuators.

* * * * *